US012631418B2

(12) United States Patent
Linscott

(10) Patent No.: US 12,631,418 B2
(45) Date of Patent: May 19, 2026

(54) TAKEDOWN FIREARM

(71) Applicant: Savage Arms, Inc., Westfield, MA (US)

(72) Inventor: John Linscott, Easthampton, MA (US)

(73) Assignee: Savage Arms, Inc., Westfield, MA (US)

( * ) Notice: Subject to any disclaimer, the term of this patent is extended or adjusted under 35 U.S.C. 154(b) by 0 days.

(21) Appl. No.: 18/923,305

(22) Filed: Oct. 22, 2024

(65) Prior Publication Data

US 2025/0044052 A1 Feb. 6, 2025

Related U.S. Application Data

(63) Continuation-in-part of application No. PCT/US2023/019512, filed on Apr. 22, 2023.

(60) Provisional application No. 63/342,832, filed on May 17, 2022, provisional application No. 63/333,620, filed on Apr. 22, 2022.

(51) Int. Cl.
*F41A 21/48* (2006.01)
*F41A 11/00* (2006.01)

(52) U.S. Cl.
CPC ..... *F41A 21/484* (2013.01); *F41A 11/00* (2013.01)

(58) Field of Classification Search
CPC ..... F41A 21/48; F41A 21/484; F41A 21/481; F41A 11/00
See application file for complete search history.

(56) References Cited

U.S. PATENT DOCUMENTS 1,494,524 A * 5/1924 Adamson ..... F41A 21/00 285/391
1,994,489 A * 3/1935 Simpson ..... F41A 21/484 42/1.07
2,345,127 A 3/1944 Kehne
2,539,494 A 1/1951 Edith
2,679,123 A * 5/1954 Williams ..... F41C 23/16 42/75.02
2,736,119 A * 2/1956 Clarkson ..... F41A 21/12 42/76.02

(Continued)

OTHER PUBLICATIONS

PCT International Search Report and Written Opinion in International Application No. PCT/US2023/019512, dated Aug. 25, 2023, 12 pages.

(Continued)

*Primary Examiner* — Joshua E Freeman
(74) *Attorney, Agent, or Firm* — Christensen, Fonder, Dardi & Busse PLLC; Timothy J. Busse; Douglas J. Christensen

(57) ABSTRACT

A takedown firearm that may utilize removable barrels of different calibers. The disclosed firearm does not require a barrel extension, instead providing positioning of the barrel that is sufficiently precise and repeatable. Tensioning of the barrel is provided passively during installation of the removable barrel, without need for adjustment or additional tightening. Securing the removable barrel to the receiver does not structurally involve the fore end, thereby avoiding harmonics effects associated with fore end interfaces to the receiver. The firearm takes advantage of an "underspaced" chamber arrangement to provide additional tolerance for manufacturing and assembly of the firearm.

12 Claims, 11 Drawing Sheets

(56) References Cited

U.S. PATENT DOCUMENTS

| | | | | |
|---|---|---|---|---|
| 4,685,235 | A * | 8/1987 | Bunning | F41A 21/481 89/14.05 |
| 8,191,480 | B2 | 6/2012 | Mcaninch | |
| 8,844,423 | B1 | 9/2014 | Ubl et al. | |
| 9,513,076 | B2 | 12/2016 | Kolev et al. | |
| 9,599,417 | B2 | 3/2017 | Kolev et al. | |
| 9,810,496 | B2 | 11/2017 | Kolev et al. | |
| 10,161,699 | B2 * | 12/2018 | Sessions | F41A 11/00 |
| 10,788,277 | B2 | 9/2020 | Kolev et al. | |
| 12,111,127 | B1 * | 10/2024 | Withey | F41A 21/482 |
| 2005/0188591 | A1 | 9/2005 | Stone | |
| 2007/0277669 | A1 * | 12/2007 | Tertin | F41A 11/02 42/69.02 |
| 2008/0066361 | A1 * | 3/2008 | Aalto | F41A 21/484 42/76.01 |
| 2008/0178510 | A1 * | 7/2008 | Paasikivi | F41A 21/48 42/76.01 |
| 2017/0016688 | A1 | 1/2017 | Withey | |
| 2017/0138680 | A1 | 5/2017 | Fellows | |
| 2018/0283821 | A1 * | 10/2018 | Dodson | F41A 21/12 |
| 2021/0148662 | A1 | 5/2021 | Kolev et al. | |
| 2022/0236029 | A1 * | 7/2022 | Landies, III | F41A 21/484 |

OTHER PUBLICATIONS

Extended European Search Report in European Application No. 23792623.3, dated Mar. 27, 2026, 9 pages.

* cited by examiner

TAKEDOWN FIREARM

RELATED APPLICATIONS

This application is a bypass continuation-in-part of PCT/US2023/019512, filed Apr. 22, 2023, and which claims the benefit of U.S. Provisional Patent Application No. 63/333,620, filed Apr. 22, 2022, and of U.S. Provisional Patent Application No. 63/342,832, filed May 17, 2022, the disclosures of which are hereby incorporated by reference herein in their entirety.

BACKGROUND OF THE DISCLOSURE

Takedown rifles or other firearms where the barrel quickly detaches from the receiver portion can present inherent disadvantages relative to traditional configurations wherein the barrel is permanently or very rigidly attached to the receiver. A takedown style firearm that mitigates or eliminates such inherent potential disadvantages would be welcomed.

SUMMARY OF THE DISCLOSURE

The disclosed firearms are suitable for both lower and higher-powered cartridges, utilizing either a straight blowback (non-chamber spaced) or delayed blowback (chamber spaced) action depending on the caliber. The higher-powered calibers are effective at longer distances (often 200+ yards). The disclosed takedown is designed to provide: a takedown configuration that is suitable for higher powered rimfires that have delayed blowback and thus require precise chamber space definition; improved takedown ergonomics with no adjustability required by the user; repeatable high tension in barrel/receiver joint for maximum accuracy and re-zero ability for longer distance calibers; less complexity and manufacturing cost. In embodiments, the firearm is a bolt action firearm. In embodiments, the firearm is configured for centerfire cartridges.

In conventional firearms, the barrel is rigidly secured to the receiver by high-retention methods that create a rigid joint which is advantageous to the accuracy of the firearm. One example of a rigid joint is a threaded locknut, wherein the barrel is threaded to the receiver and a locknut is threaded onto the barrel and tightened against the receiver. Another example is to attach the barrel to the receiver by drilling through both and installing press fit pins. In both cases, the axial position of the barrel needs to be set according to the required chamber space of the firearm, unless the firearm is a straight blowback for which the chamber space is self-adjusting. Such methods are effective at creating a rigid joint, but neither provides a takedown that can be quickly disassembled and reassembled. In the former design, the locknut would need to be removed. The locknut is typically set with very high torque and requires special tooling to remove. In the latter design, the pins would need to be punched out.

A takedown firearm is generally perceived as one that can be quickly assembled to full-functionality, often in the field, and in a matter of seconds. Complexities arise when a takedown design is locked breech and requires precise definition of a chamber space. If the barrel position is not set to within adequate tolerances, the cartridges could rupture when the firearm is discharged, posing safety concerns. Some takedown designs include a barrel extension that maintains chamber space in a fixed relationship when the firearm is disassembled. Such designs are disadvantaged because of the barrel extension, which requires a non-trivial integration and an additional part that must be mechanically fastened to the barrel. Still other takedown designs require adjusting the tension of the joint. That is, the barrel is attached, and the joint is made tighter by an adjustment. The tension adjustment is effective to add rigidity to the joint, but requires additional steps for full effectiveness.

Another consideration in takedown designs is barrel harmonics. Poorly secured barrels can result in compromised barrel harmonics and an inconsistent point of impact as the position of the barrel to the receiver can shift from shot to shot. Some take down designs feature a fore end that is connected to the receiver at two interfaces: one creates tension between the receiver and the fore end; the other does not, but instead prevents rotation (e.g., a plunger/detent arrangement). From a firearm harmonics/vibrations standpoint, having one tensioned interface and one non-tensioned interface in this manner is not desirable. The non-tensioned interface can have a negative effect on the barrel harmonics during firing.

Takedown designs that do not include a barrel extension but still require chamber space definition present additional challenges because the non-bolt components that define the chamber space are separated when the barrel is removed. Chamber space action requires that the barrel be positioned relative to the locked bolt position within a tolerance of a few mils (one mil equaling 0.001 inch). Ergo, repeatability of assembly and disassembly cycles of the takedown firearm must stay within these tight tolerances, as well as between barrel assemblies that are intended to be interchangeable with the takedown firearm.

The disclosed takedown firearm mitigates the shortcomings of other takedown designs. The disclosed firearm does not require a barrel extension, instead providing positioning of the barrel that is sufficiently precise and repeatable. Tensioning of the barrel is provided passively during installation of the removable barrel, without need for adjustment or additional tightening. Securing the removable barrel to the receiver does not structurally involve any non-tensioned connections, thereby avoiding harmonics effects associated with fore end interfaces to the receiver. The firearm takes advantage of an "underspaced" chamber arrangement to provide additional tolerance for manufacturing and assembly of the firearm.

Structurally, various embodiments of the disclosure present a takedown firearm comprising a receiver, including a front receiver ring that includes a distal face and defines an inside diameter, a locking stud that extends radially inward relative to the inside diameter, and a detent plunger that extends radially inward relative to the inside diameter, the detent plunger and the locking stud being centered about a common plane. A removable barrel defines a barrel axis and defines an outer dimension at a proximal end portion, the proximal end portion including a shank portion. The shank portion includes: a proximal face and an outer surface that defines a shank diameter dimensioned for a close sliding fit with the inside diameter of the front receiver ring, the shank diameter being less than the outer dimension of the proximal end portion of the removable barrel to define a shoulder at a junction of the outer dimension and the shank portion; a locking stud track configured to guide the locking stud axially and rotationally during assembly; and a plunger track configured to guide the detent plunger axially and rotationally during assembly. The shank portion may also define a detent notch at a rotational extremity of the plunger track. A tensioner assembly includes a collar having a proximal face that defines and is concentric about a tensioner axis, the tensioner assembly defining a proximal opening and a distal opening, the proximal opening being greater than the shank diameter, and the distal opening being configured to receive the outer dimension of the proximal end portion. A biasing element may be disposed between the collar and the shoulder. The shank portion is insertable into the front receiver ring so that the locking stud track guides the locking stud and the plunger track guides the detent plunger to an interlocked configuration. In the interlocked configuration, the detent plunger is registered within the detent notch and the distal face of the front receiver ring registers against the proximal face of the collar to compress the biasing element. In some embodiments, the takedown firearm is configured to discharge rimfire ammunition. In embodiments the takedown firearm is configured to discharge centerfire ammunition.

The outer dimension may be a diameter. The detent plunger may be axially offset from the locking stud. In some embodiments, the plunger track is defined by a plunger channel radially recessed from the outer surface of the shank diameter, the line of actuation radii being a line of minimum radii of the plunger channel. The shank portion may define a neck at the junction, the neck defining an inset diameter that is less than the shank diameter. In some embodiments, the takedown firearm includes a retaining ring that axially captures the collar about the neck. In some embodiments, the removable barrel includes a barrel attachment for mounting a fore end thereto, the barrel attachment being proximate a proximal end of the removable barrel, the removable barrel being free floating distal to the barrel attachment.

In some embodiments, when in the interlocked configuration, the locking stud registers against a locking face of the track to establish a locking stud offset from the locking stud to the proximal face of the shank portion. The locking stud track may also define a cylindrical cam for guiding the locking stud in a tangential direction during assembly. In some embodiments, the cylindrical cam defines a slope relative to a radial-tangential plane of the shank, the slope being in a range of 5 degrees to 20 degrees inclusive. The slope may vary along a tangential length of the cylindrical cam within the range of 5 degrees to 20 degrees inclusive.

In some embodiments, the locking stud includes a locking interface and the cylindrical cam includes a locking seat, the locking interface being configured to register against the locking seat in the interlocked configuration. The seat and the interface may be tangentially extending flats that are parallel to the radial-tangential plane of the shank. In some embodiments, the locking seat faces in a distal direction of the removable barrel.

In some embodiments, the locking stud track includes a stop to limit rotation of the removable barrel in the interlocked configuration. The anti-rotation stop may include an axially extending flat for engagement of the locking stud.

In some embodiments, the locking stud track is defined by a channel that is radially recessed relative to the outer surface of the shank diameter. The receiver may define a receptacle configured to receive the locking stud. In some embodiments, the locking stud includes a head that mates with the receptacle to prevent rotation of the locking stud within the receptacle. The head of the locking stud may include an anti-rotation flat. In some embodiments, the receptacle includes an inner shoulder for registration of the locking stud.

In some embodiments, a line of actuation radii relative to the barrel axis is defined along the plunger track, the line of actuation radii increasing in value as the plunger track approaches the rotational extremity. The detent plunger may be biased radially inward to seat the detent plunger with the detent notch to maintain the removable barrel and the receiver in a fixed rotational relationship, and may be spring loaded. In some embodiments, the detent notch defines a first dimension at the outer surface of the shank and a second dimension that is radially inset from the outer surface of the shank, the second dimension being less than the first dimension to define a taper. The taper may include tangentially opposed surfaces that define a taper angle. In some embodiments, the taper angle is in a range from 40 to 90 degrees inclusive; in others, the taper angle is in a range from 40 to 70 degrees inclusive; in others, a range from 45 to 55 degrees inclusive.

In some embodiments, the collar includes an inner flange disposed between the proximal opening and the distal opening, the inner flange defining an inner diameter that is less than the proximal opening and the distal opening, the biasing element being axially captured between the inner flange and the shoulder. The flange may define a counterbore that centers the biasing element about the tensioner axis. In some embodiments, the biasing element includes an clastic body having a modulus of elasticity that is within a range of 10 to 20 MPa inclusive. The biasing element may be an o-ring, and may define a rectangular cross-section normal to a tangential direction.

In various embodiments of the disclosure, the detent plunger is unseated from the detent notch by application of a torsion between the receiver and the removable barrel, the torsion being in a range of 20 in-lbf to 35 in-lbf inclusive.

Various embodiments of the disclosure comprise a method for underspacing a chamber of a takedown firearm, comprising: identifying an ideal position of a chamber face of a takedown firearm that corresponds to the contact location of a bolt face when a bolt assembly is in a battery configuration; fabricating a removable barrel to include a proximal face that, when the takedown firearm is in a fully interlocked configuration, establishes the chamber face; and fabricating the removable barrel to position the proximal face of the removeable barrel proximal to the ideal position of the chamber face, thereby providing an underspaced chamber. In some embodiments, the method includes configuring the takedown firearm for delayed blowback operation, wherein a firing pin of the takedown firearm is not blocked because of the underspaced chamber. The method may include configuring the takedown firearm for discharging rimfire ammunition and/or centerfire ammunition. In some embodiments, the takedown firearm is manufactured so that a distance between the proximal face of the removable barrel and the ideal position of the chamber face does not exceed 12 mils.

In some embodiments, the step of fabricating the removable barrel to position the proximal face includes: securing a locking stud to extend radially inward from an inside dimension of a receiver ring of the takedown firearm, the locking stud including a locking interface; and forming a locking seat on the removable barrel to seat against the locking interface to position the proximal face of the removeable barrel for definition of the underspaced chamber. The method may include forming a flat on the locking stud to establish the locking interface, and forming a flat on the locking seat for mating with the locking interface. In some embodiments, the method includes forming a locking stud track on the removeable barrel to rotationally guide the removeable barrel over the locking stud and into contact with the locking seat during assembly of the takedown firearm. The method may also include forming the locking stud track to axially guide the removeable barrel over the locking stud.

DETAILED DESCRIPTION OF THE DRAWINGS

Figure 1:
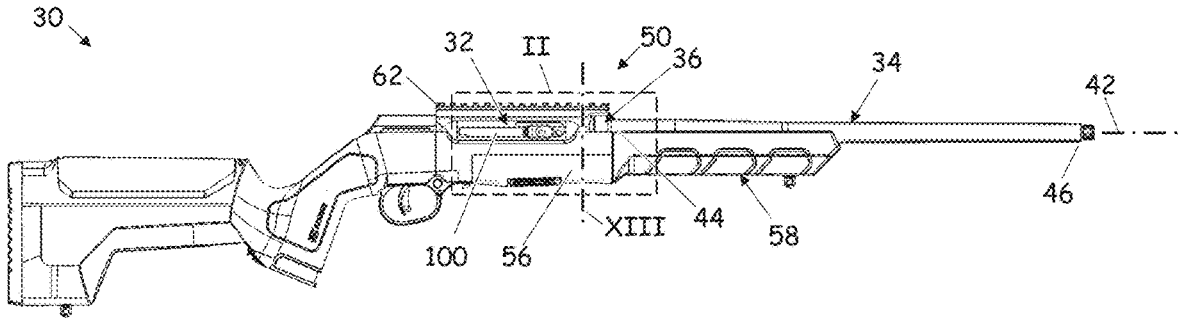
FIG. 1 is a side elevational view of a rimfire takedown firearm according to an embodiment of the disclosure.
Figure 2:
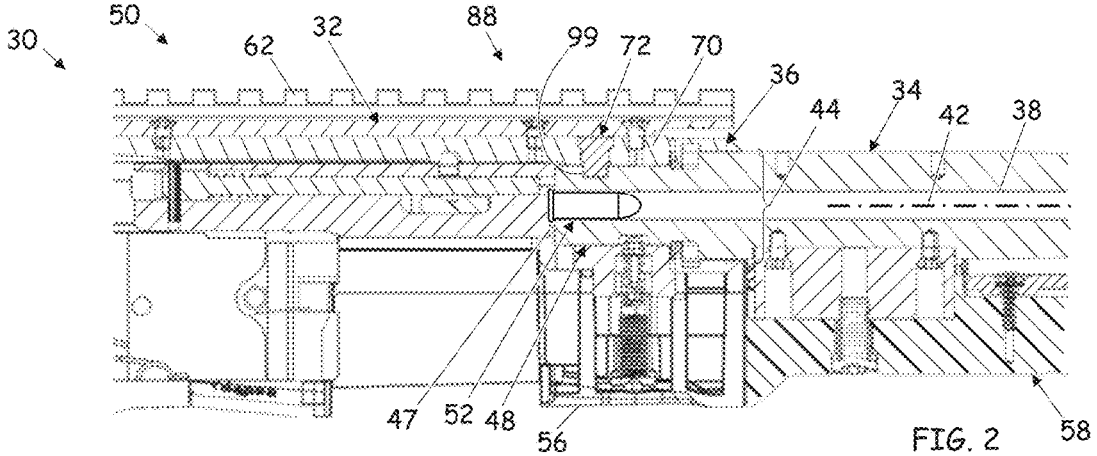
FIG. 2 is an enlarged partial sectional view at a mid-plane of inset II of FIG. 1 according to an embodiment of the disclosure.

Referring to FIGS. 1 and 2, a rimfire takedown firearm 30 is depicted according to an embodiment of the disclosure. The rimfire takedown firearm 30 includes a receiver 32, a removable barrel 34, and a tensioner assembly 36. The removable barrel 34 defines a bore 38 that is concentric about a barrel axis 42 and includes a proximal end portion 44 and a distal or muzzle end portion 46. The proximal end portion 44 of the removable barrel 34 defines a chamber 47 and includes a shank portion 48 that is configured to selectively and securely interlock with the receiver 32. The removable barrel 34 includes a barrel body 49 that extends distally from the shank portion 48. The rimfire takedown firearm 30 is depicted in a battery configuration 50 with a rimfire cartridge 52 (casing 53 and bullet 54) in the chamber 47. The rimfire takedown firearm 30 may also include several components associated with long rifles, including a stock 56, a fore stock or fore end 58, and a scope mount 62.

Figure 3:
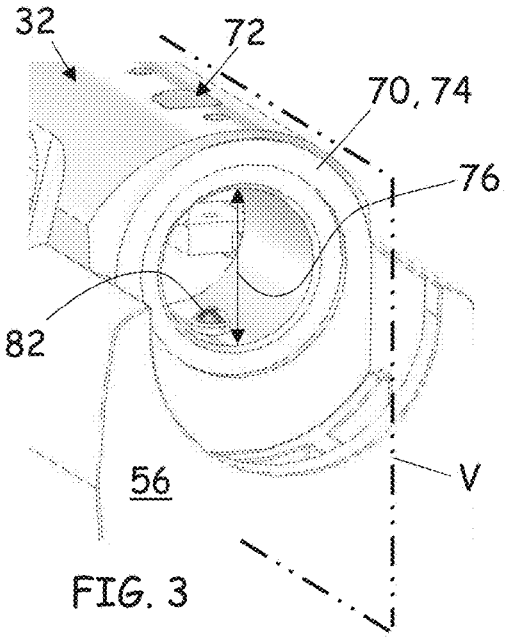
FIG. 3 is a front perspective view of a receiver of the firearm of FIG. 1 according to an embodiment of the disclosure.
Figure 4:
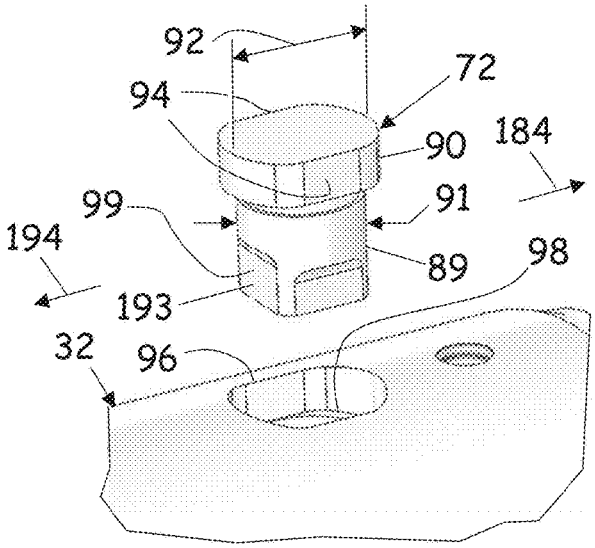
FIG. 4 is an exploded view of a locking stud and complementary receptacle of the receiver of FIG. 3 according to an embodiment of the disclosure.
Figure 5:
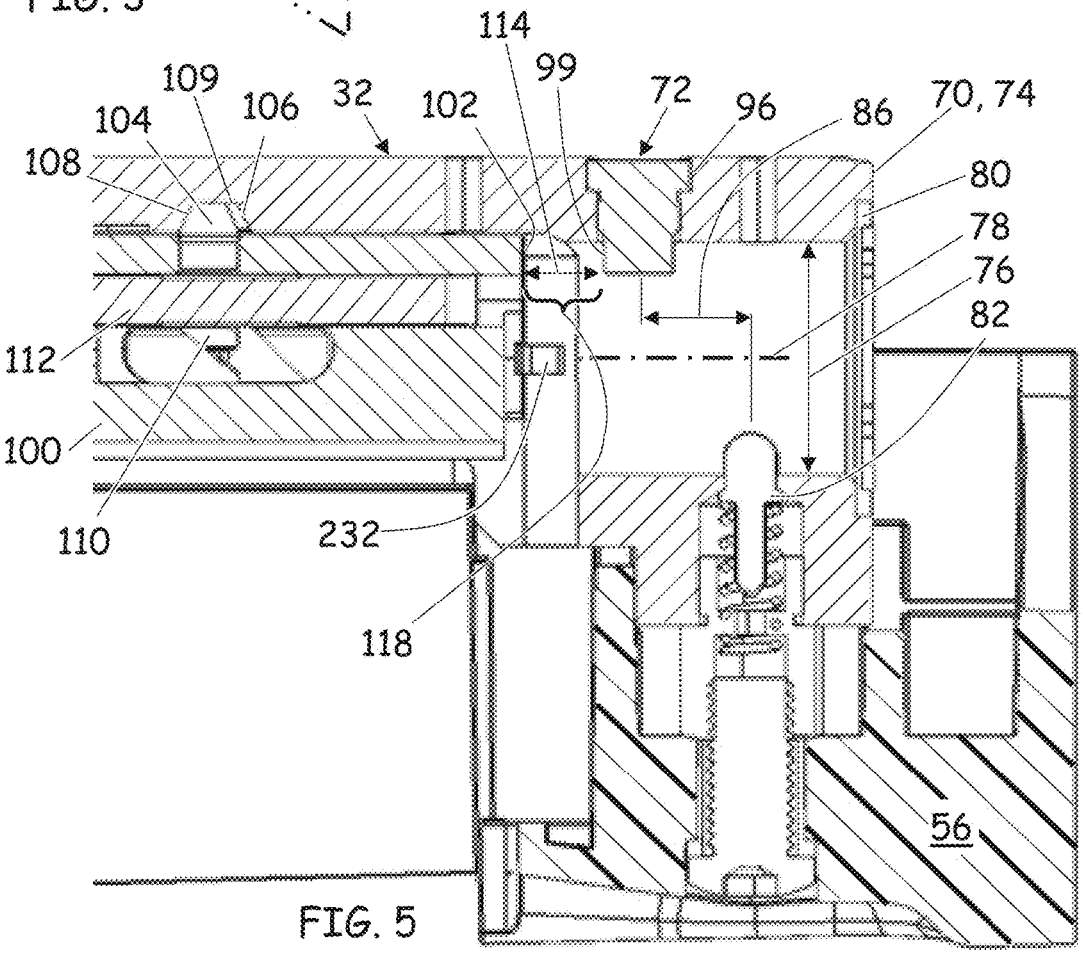
FIG. 5 is a sectional view of the receiver at plane V of FIG. 3 with a bolt assembly housed therein according to an embodiment of the disclosure.

Referring to FIGS. 3 through 5, the receiver 32 is depicted in greater detail according to an embodiment of the disclosure. The receiver 32 includes a front receiver ring 70 and a locking stud 72. The front receiver ring 70 includes a distal face 74 and defines an inside diameter 76, the inside diameter 76 defining and being concentric about a receiver axis 78. The distal face 74 may define a counterbore 80 that faces distally. The locking stud 72 extends radially inward relative to the inside diameter 76. In some embodiments, a detent plunger 82 extends radially inward relative to the inside diameter 76, the detent plunger 82 and the locking stud 72 being centered about a common plane V that extends axially (i.e., in the proximal and distal directions 194 and 184 of FIG. 13). In some embodiments, the barrel axis 42 is substantially coplanar with the common plane V when the removable barrel 34 and the receiver 32 are in a fully interlocked configuration 88. An axial separation 86 may be defined between the centers of the detent plunger 82 and the locking stud 72.

In some embodiments, the locking stud 72 includes a body portion 89 and a head portion 90 that may be configured for fixed and permanent coupling with the receiver 32. Generally, the head portion 90 may define an asymmetrical geometry that prevents rotation of the locking stud 72 once mounted to the receiver 32.

In some embodiments, there are three aspects to the locking stud 72 that facilitate such coupling with the receiver 32: a body diameter 91 defined by the body portion 89; a head diameter 92 interrupted by at least one flat 94; and a receptacle 96 configured to provide interference fits with the diameters 91 and/or 92. In some embodiments, the receptacle 96 defines an inner shoulder 98. The body diameter 91 may be dimensioned to provide the primary press fit into the receiver 32. The head diameter 92 is larger than the body diameter 91 and may also be dimensioned to provide an interference fit with the receptacle 96. There may be a light interference or close clearance fit between the receptacle 96 and the flat(s) 94. In assembly, the locking stud 72 is pressed into the receptacle 96, and the body diameter 91 bottoms out against the inner shoulder 98.

The locking stud 72 includes a locking interface 99 that registers against the removable barrel 34 when the receiver 32 and the removable barrel 34 are in the fully interlocked configuration 88 (FIG. 2). The location and rotational orientation is permanently fixed by the coupling of the locking stud 72 to the receptacle 96, the locking interface 99 providing a precisely positioned and oriented surface for interlocking the removable barrel 34. Also, the tensioning of the barrel as provided by the tensioner assembly 35 is repeatable, thereby negating the need for tensioning adjustment in the field.

Functionally, the press fits between the diameters 91 and/or 92 secure the locking stud 72 to the receiver 32 so as not to be dislodged during live fire. The close fit of the flat(s) 94 establishes the rotational position of the locking stud 72 relative to the receiver 32. The use of diametrical geometries for the press fits enables machining to within precise tolerances. For embodiments that include two diametrically opposed flats 94, the locking stud 72 may be axi-symmetrical. The top of the head portion 90 may be devoid any external drive (e.g., socket or hex flats), as the locking stud 72 is not intended to be removed by the user.

The tangentially extending flats 193 of the locking interface 99 enables use of less expensive material for the locking stud 72. That is, forces that are exerted against the locking interface 99 are spread over a larger area than, say, a cylinder against a plane, which avoids rapid peening of the interlocked surfaces during live fire. The axial separation 86 stabilizes the removable barrel 34 to mitigate against vertical movement (pitch), providing resistance to vibration at the joint between the removable barrel 34 and the receiver 32.

The receiver 32 is configured to house a bolt assembly 100 that reciprocates within the receiver 32. The bolt assembly 100 includes a bolt face 102. For delayed blowback embodiments, the bolt assembly 100 includes a locking lug 104 that locks against a locking pocket 106 defined by the receiver 32. When the bolt assembly 100 is in the battery configuration 50, the locking lug 104 of the bolt assembly 100 is set against a proximal extremity 108 of the locking pocket 106 and engaged with an upper surface 109 of the locking pocket (FIG. 5). The locking lug 104 includes or is otherwise connected to a stem 110 that is configured to block actuation of a firing pin 112, also is housed in the bolt assembly 100, unless the stem 110 is sufficiently vertically positioned (i.e., unless the locking lug 104 is sufficiently seated vertically within the locking pocket 106). The blocking feature of the stem 110 prevents discharge of the firearm 30 until the bolt assembly 100 is locked within the receiver 32.

When in the bolt assembly 100 is in the battery configuration 50, a locking stud offset 114 is defined as an axial length from the locking interface 99 to the bolt face 102. The locking stud offset 114 defines an ideal axial length of an interlocking zone 118 within which the removable barrel 34 is captured when the rimfire takedown firearm 30 is in the fully interlocked configuration 88.

Figure 6:
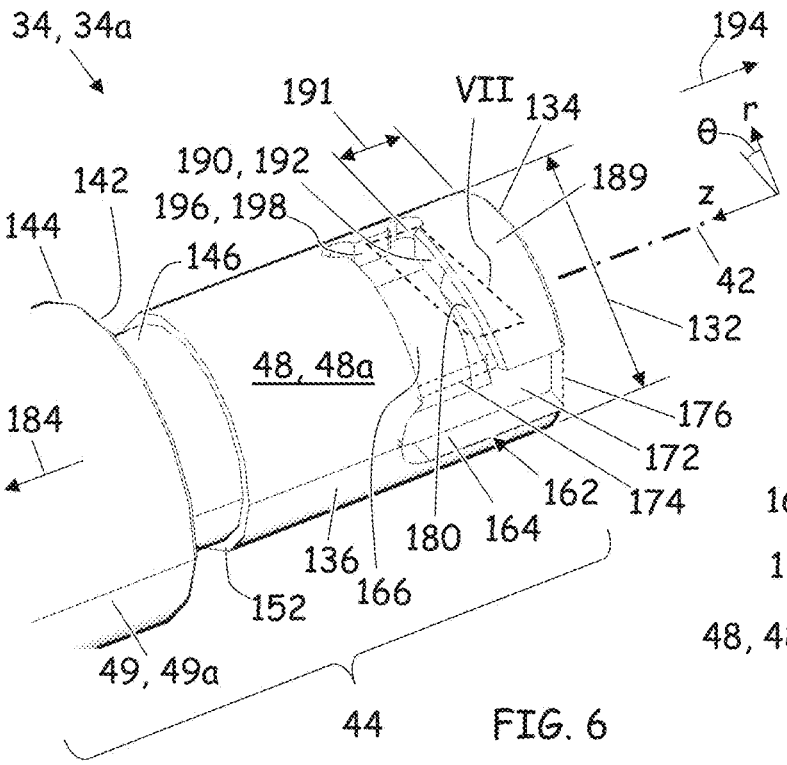
FIG. 6 is a front perspective view of a locking stud track at the proximal end portion of the removable barrel of FIG. 1 according to an embodiment of the disclosure.
Figure 7:
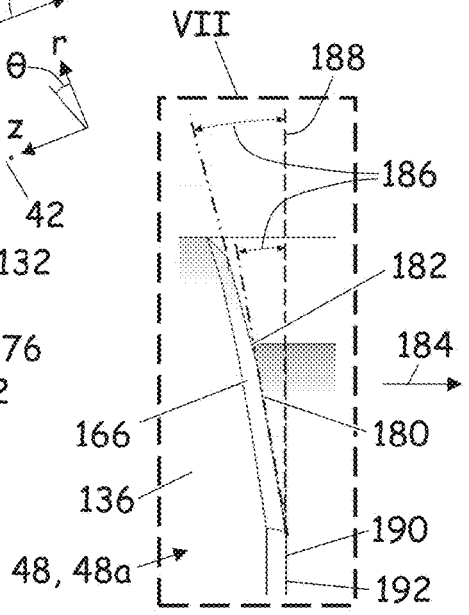
FIG. 7 is a plan view of a cam surface of the locking stud track as viewed perpendicular to planar inset VII of FIG. 6 according to an embodiment of the disclosure.
Figure 8:
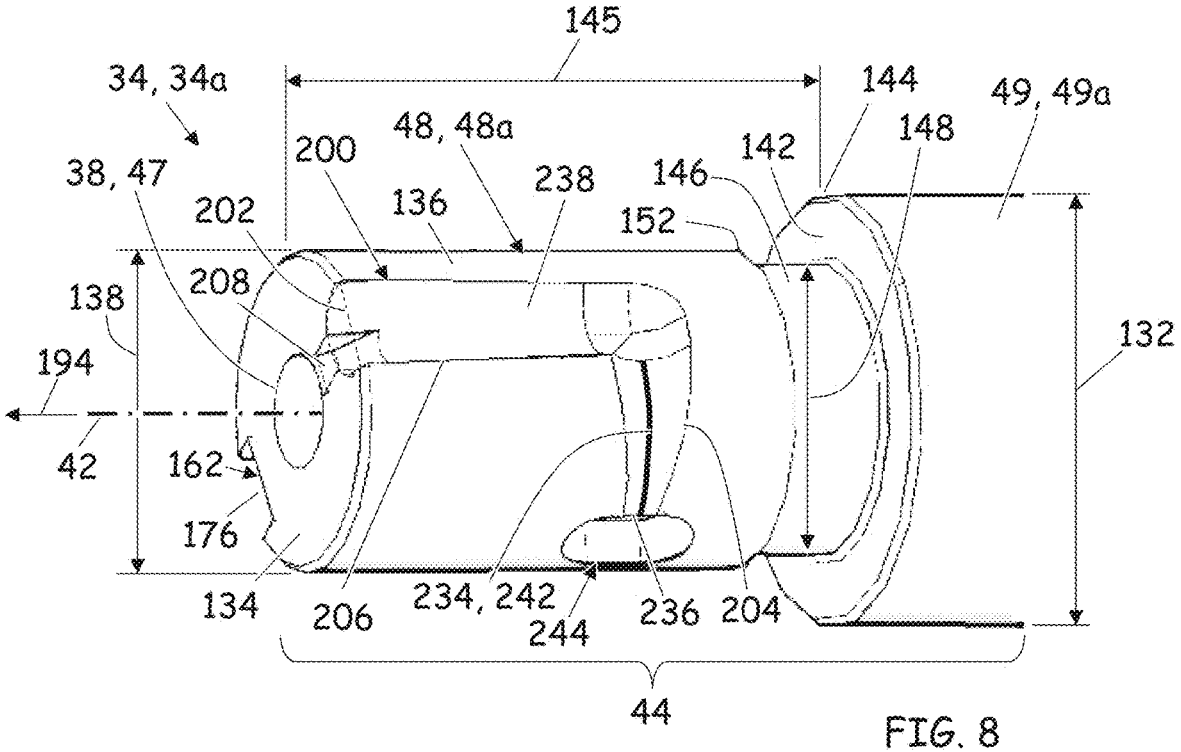
FIG. 8 is a rear perspective view of a plunger track at a proximal end portion of a removable barrel of FIG. 6 according to an embodiment of the disclosure.

Referring to FIGS. 6 through 8, the removable barrel 34 is depicted in greater detail according to an embodiment of the disclosure. The proximal end portion 44 of the removable barrel 34 defines an outer dimension 132 that is distal to the shank portion 48. The outer dimension 132 may be a diameter (depicted). The shank portion 48 includes a proximal face 134 and an outer surface 136 defines a shank diameter 138 dimensioned for a close sliding fit with the inside diameter 76 of the front receiver ring 70 (FIG. 5). The shank diameter 138 is less than the outer dimension 132 of the proximal end portion 44 of the removable barrel 34 to define a shoulder 142 of the barrel body 49 at a junction 144 of the barrel body 49 and the shank portion 48. An overall length 145 of the shank portion 48 is defined as the axial distance between the shoulder 142 and the proximal face 134. The shank portion 48 may define a neck 146 at the junction 144, the neck 146 defining an inset diameter 148 and a shank shoulder 152.

The shank portion 48 includes a locking stud track 162 configured to guide the locking stud 72 axially and rotationally about the shank portion 48 during assembly. In some embodiments, the locking stud track 162 is defined by a channel 164 that is radially recessed relative to the outer surface 136 of the shank diameter 138. The locking stud track 162 defines a cylindrical cam 166 for guiding the locking stud 72 in a tangential direction during assembly. The locking stud track 162 may also define an axial run 172 for guiding the locking stud 72 to an inlet 174 of the cylindrical cam 166. In some embodiments, the locking stud track 162 defines an access 176 to the locking stud track 162 at the proximal face 134 of the shank portion 48.

In some embodiments, the cylindrical cam 166 includes a cam surface 180 that faces distally, and may define an axial incline or convexity 182 in a distal direction 184. In some embodiments, the cam surface 180 defines one or more slopes 186 relative to a radial-tangential plane 188 of the shank portion 48, the slope 186 being in a range of 5 degrees to 20 degrees inclusive. The slope(s) 186 may be constant (e.g., defined by flat surfaces) or vary along the cylindrical cam 166 (e.g., defined by an arcuate surface) within the range of 5 degrees to 20 degrees inclusive. Herein, a range that is referred to as "inclusive" includes the stated end-point values of the range as well as all values therebetween.

The cylindrical cam 166 includes a locking seat 190 configured to register against the locking interface 99 of the locking stud 72 when the removable barrel 34 and the receiver 32 are in the fully interlocked configuration 88. An interlocking segment 189 of the removable barrel 34 is characterized as the segment of the shank portion 48 that extends in a proximal direction 194 from the locking seat 190 to the proximal face 134. The interlocking segment 189 defines an axial length referred to herein as a locking seat offset 191 (i.e., an axial offset between the proximal face 134 and the locking seat 190 of the shank portion 48). The interlocking segment 189 is identified in FIGS. 19 and 20 with a stipple pattern for clarity.

In some embodiments, the locking seat 190 of the cylindrical cam 166 and the locking interface 99 of the locking stud 72 are tangentially extending flats 192 and 193, respectively, that are parallel to the radial-tangential plane 188. The flats 192 act to spread the contact forces at the interface of the locking interface 99 and the locking seat 190 over an area for reduced stress concentrations.

In the fully interlocked configuration 88, the locking seat 190 faces in the distal direction 184 and orthogonal to the barrel axis 42, and the locking interface 99 faces in the proximal direction 194 and orthogonal to the barrel axis 42. The locking stud track 162 may include a rotation stop 196 to limit rotation of the removable barrel 34 in the fully interlocked configuration 88. In some embodiments, the rotation stop 196 includes an axially extending flat 198 for engagement of the locking stud 72.

In some embodiments, the shank portion 48 includes a plunger track 200 configured to guide the detent plunger 82 axially and rotationally about the shank portion 48 during assembly. The plunger track 200 defines an access 202 at the proximal face 134 of the shank portion 48, and may include a tangential run 204 and an axial run 206 that correspond to the cylindrical cam 166 and axial run 172 of the locking stud track 162. A lead in 208 may also be defined at the access 202 to accommodate an extractor 232 (FIG. 5).

In some embodiments, the shank portion 48 and barrel body 49 of the removable barrel 34 are fabricated from a single forging, referred to herein as a unitary removable barrel 34*a* having a shank portion 48*a* and a barrel body 49*a* that are unitary (FIGS. 6 and 8). Herein, removable barrel(s) having shank portion(s) and barrel body or bodies are referred to generically or collectively by reference characters 34, 48, and 49 respectively, whereas specific or individual embodiments are followed by a letter suffix (e.g., "removable barrel 34*a*", "shank portion 48*a*", and "barrel body 49*a*").

Figure 9:
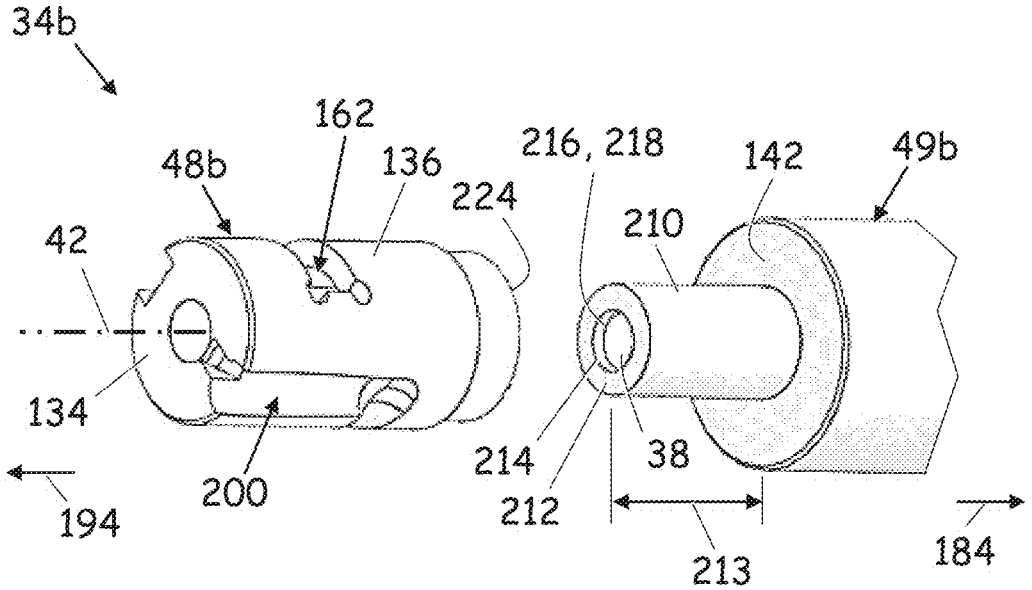
FIG. 9 is a partial perspective view of a shank portion and a barrel body for an integrated removable barrel according to an embodiment of the disclosure.
Figure 10:
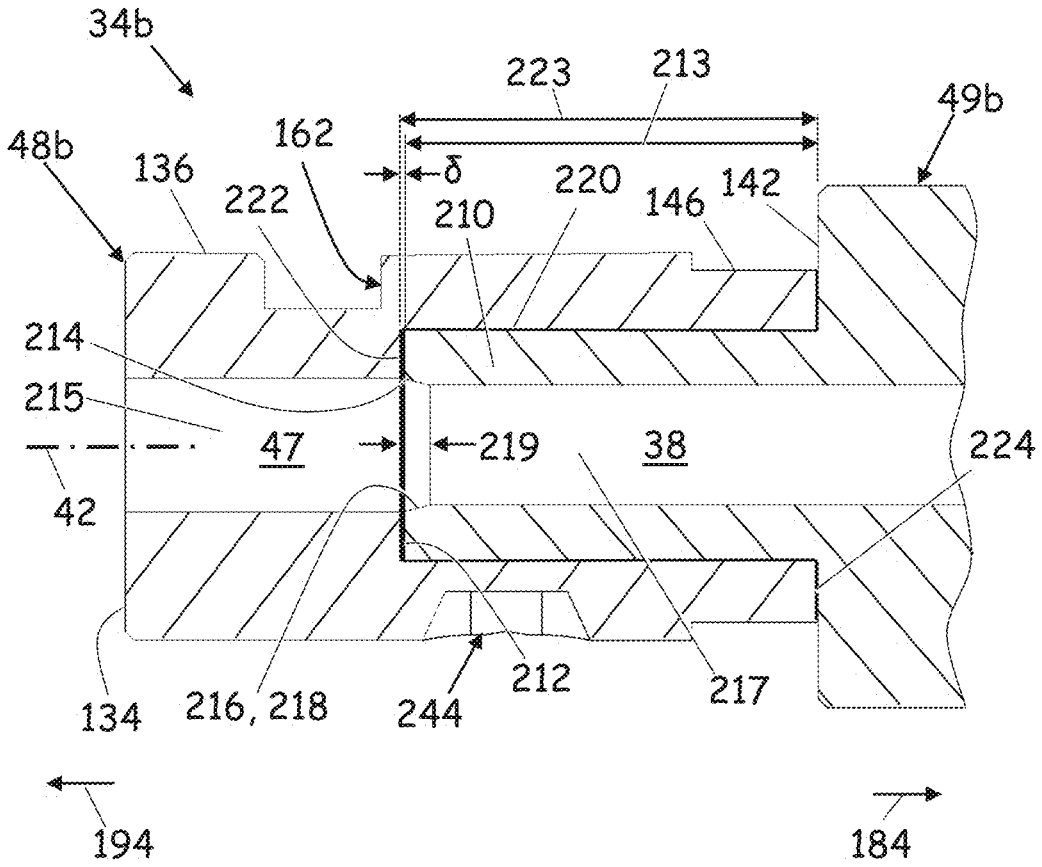
FIG. 10 is a partial sectional view of the integrated removable barrel of FIG. 9 after assembly according to an embodiment of the disclosure.

Referring to FIGS. 9 and 10, an integrated removable barrel 34*b* is depicted according to an embodiment of the disclosure. The integrated removable barrel 34*b* is so-named because a shank portion 48*b* and a barrel body 49*b* are integrated after being fabricated separately. This is in contrast to the unitary removable barrel 34*a* for which the shank portion 48*a* and the barrel body 49*a* are fabricated from a single forging. The integrated removable barrel 34*b* may include many of the same attributes as the unitary removable barrel 34*a*, some of which are indicated with same-labeled reference characters.

The barrel body 49*b* includes a reduced diameter stem 210 that extends proximally from the shoulder 142 to a stem face 212 that faces in the proximal direction 194, the reduced diameter stem 210 defining an axial length 213. The reduced diameter stem 210 surrounds a portion of the bore 38 to define a mouth 214. In some embodiments, the chamber 47 is defined in two portions: a proximal portion 215 that is defined by the shank portion 48*b* and a distal portion 217 that is defined by the barrel body 49*b*. In some embodiments, the distal portion 217 of the chamber 47 includes a forcing cone or frustrum 216 that is essentially a countersink 218 of length 219 at the mouth 214 of the reduced diameter stem 210. In this embodiment, the proximal portion 215 of chamber 47 is defined within the shank portion 48*b*.

The shank portion 48*b* defines a counterbore 220 that includes an internal bore face 222 facing in the distal direction 184, the counterbore 220 being configured to receive the reduced diameter stem 210. An axial length 223 of the counterbore 220 is defined from a distal end 224 of the shank portion 48*b* to the internal bore face 222. A gap δ may be defined between the proximal portion 215 and distal portion 217 of the chamber 47 (i.e., between the stem face 212 and the internal bore face 222). While the overall length 145 of the shank portion 48*b* is the same (within specified tolerance) for any removable barrel 34*b*, the axial lengths 213, 219, and 223 generally differ with the caliber of the removable barrel 34*b* pursuant to the specifications of the chamber 47 for the cartridge 52 associated with the caliber.

In assembly, the integrated removable barrel 34*b* may be integrated so that the shank portion 48*b* and the barrel body 49*b* are effectively inseparable, or at least separable only with substantial effort, for instance by a gunsmith. The counterbore 220 and the reduced diameter stem 210 may be configured for an interference fit. Integration of the shank portion 48*b* and barrel body 49*b* may include press fitting, thermal expansion/contraction techniques, and radial pins (not depicted) to secure the components. In some embodiments, the counterbore 220 and the reduced diameter stem 210 are axially dimensioned to define the gap δ after assembly. The gap δ may be defined by reducing the axial length 219 of the countersink 218. Alternatively or in combination, the gap δ may be defined by increasing the axial length 223 the counterbore 220, which positions the internal bore face 222 further in the proximal direction 194.

An assembly whereby the gap δ is effectively zero is also contemplated. The gap δ may be minimized by a combination of tight machining tolerances and an application of a torsion to the threads 228, 230 that causes elongation of the shank in assembly. As such, for some embodiments, the gap δ may be within a range 0 to 4 mils inclusive.

Figure 11:
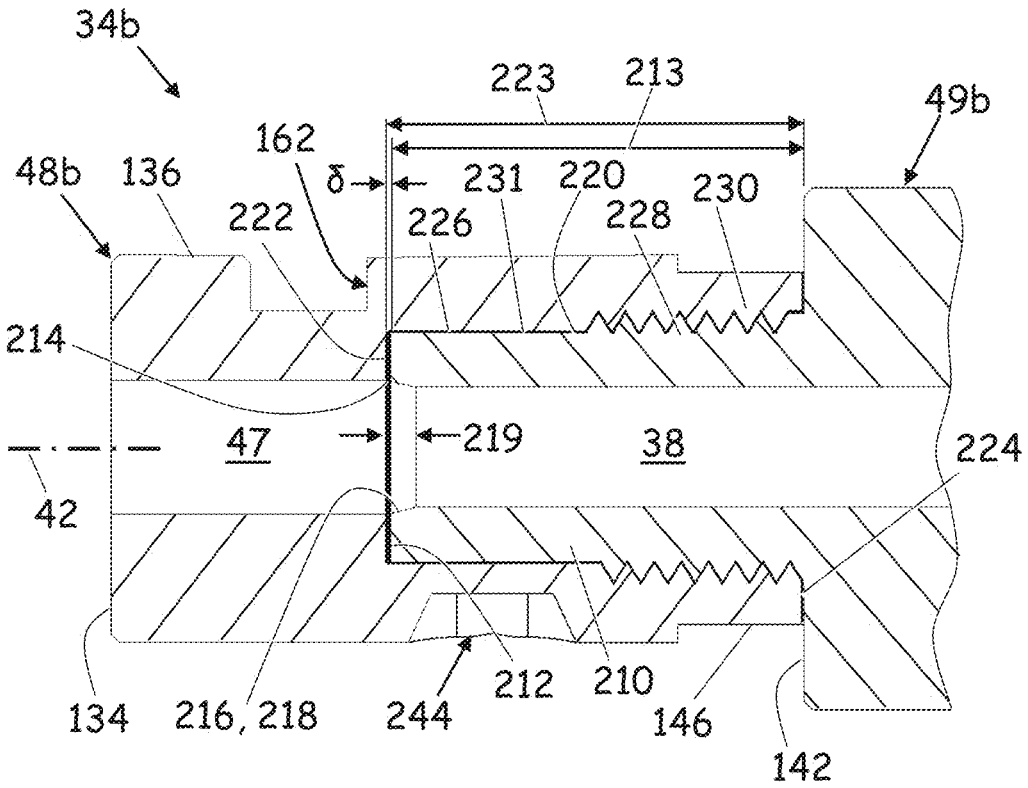
FIG. 11 is a partial sectional view of an alternative integrated removable barrel after assembly according to an embodiment of the disclosure.

Referring to FIG. 11, an integrated removable barrel 34*c* is depicted according to an embodiment of the disclosure. The integrated removable barrel 34*c* may include many of the same attributes as the integrated removable barrel 34*b*, some of which are indicated with same-labeled reference characters. A distinction of the integrated removable barrel 34*c* is a shank portion 48*c* and a barrel body 49*c* configured for threaded coupling. The reduced diameter stem 210 may include a pilot portion 226 at a proximal end and a threaded portion 228 between the pilot portion 226 and the shoulder 142 of the barrel body 49*c*. The counterbore 220 includes a threaded wall 230 for threadable engagement with the threaded portion 228, and may include a smooth bore portion 231 that corresponds to and forms a close sliding fit with the pilot portion 226.

In assembly, the threaded portion 228 and threaded wall 230 are engaged and the shank portion 48*c* drawn tightly against the shoulder 142 of the barrel body 49*c*. A high torsion (e.g., 60 ft-lbf) may be applied during assembly of the threaded members 228, 230 to secure the shank portion 48*c* and barrel body 49*c* together. Thread-locking adhesive such as ROCKSETT may also be applied to the threads to further resist separation of the threaded members 228, 230. In some embodiments, the diameter of the pilot portion 226 is machined to within a close tolerance, enabling a slip fit between the reduced diameter stem 210 and the counterbore 220 prior to engagement of the threads 228, 230. In some embodiments, the assembly is performed using a mandrel for enhanced concentricity between the inner diameter of the counterbore 220 and the outer diameter of the reduced diameter stem 210.

Functionally, fabricating the shank portion 48*b*, 48*c* separately from the barrel body 49*b*, 49*c* enables the use of different materials or different properties for these components. For example, the shank portion 48*b*, 48*c* can be of a high grade of through-hardened tool steel (e.g., the same material as the locking stud 72), while the barrel body 49*b*, 49*c* can be of a different grade of steel (e.g., a lower grade that is non heat treated) for reduced costs. The ability to use harder, higher grade steel for the shank portion 48*b*, 48*c* can avoid the need for application of hardened finish coatings (e.g., MELONITE®) that can tear through and gall under the high camming forces associated with operation of the take-down aspect. The separate components also facilitate the use of different finishes with reduced masking requirements (e.g., a polished finish for the shank portion 48*b*, 48*c* and a non-polished or matte finish for the barrel body 49*b*, 49*c*.

Bifurcating the exterior of the removable barrel 34*b*, 34*c* at the shoulder 142 of the barrel body 49*b*, 49*c* enables the specified tolerances of the structures formed on the outer surface 136 of the shank portion 48*b*, 48*c* (e.g., the locking seat offset 191) to be maintained in fabrication. Bifurcating the chamber 47 facilitates machining of the forcing cone 216, as the countersink 218 is a simple fabrication step at the mouth 214 of the reduced diameter stem 210. Also, the countersink 218 may be manufactured slightly oversized at the stem face 212 without adverse effect, enabling greater tolerance for misalignment between the proximal portion 47*a* and the distal portion 47*b* of the chamber 47 without adverse effect.

Forming the forcing cone 216 in the barrel body 49*b*, 49*c* and the remainder of the chamber 47 defined within the shank portion 48*b*, 48*c* tends to mitigate sighting inaccuracies caused by a slight axial misalignment between the shank portion 48*b*, 48*c* and the barrel body 49*b*, 49*c* that would be required should the bifurcation be located proximal to the forcing cone 216. The portion of the chamber 47 that is proximal to the forcing cone 216 is machined to tight tolerances (e.g., to within +/−1 mil). To bifurcate the chamber 47 proximal to the forcing cone 216 would require alignment of the two sections to within such tolerance to prevent skiving of the bullet 54 due to diametral mismatch. Diametral mismatch proximal to the forcing cone 216 may also create an inside step proximal to the forcing cone 216 which may form an impression on the casing 53 during discharge that snags on the internal step during extraction. On the other hand, an oversized dimeter at the proximal end of the forcing cone 216 does not create an inside step and thus does not present a snagging hazard.

The gap δ assures that the distal end 224 of the shank portion 48*b*, 48*c* is tightly registered against the shoulder 142 of the barrel body 49*b*, 49*c* in assembly. The tight registration prevents formation of a gap at the shoulder 142 and also provides proper definition of certain dimensions, such as the gap 358 between the fore end 58 and the stock 56 (discussed attendant FIG. 14) and the barrel tension distance 372 (discussed attendant FIGS. 15 and 16). The shoulder 142 also provides seating against the largest diameter face of the barrel body 49*b*, 49*c*, which may enhance perpendicular registration between the shank portion 48*b*, 48*c* and the barrel body 49*b*, 49*c*.

Figure 12:
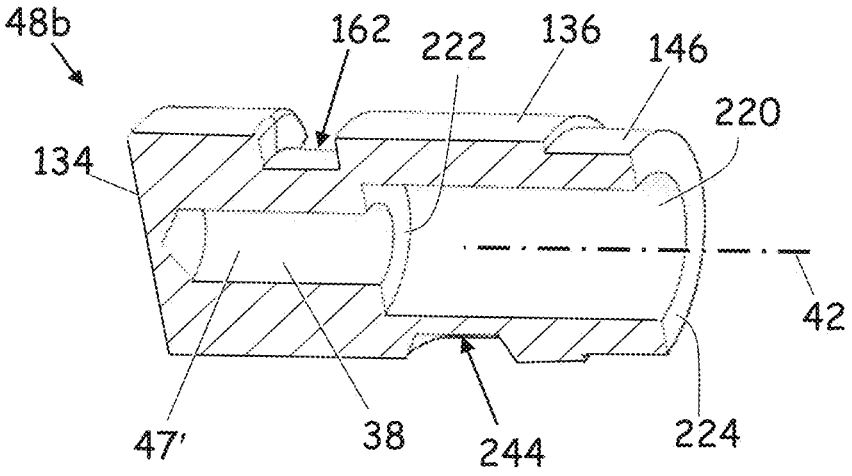
FIG. 12 is perspective sectional view of a partially completed shank portion according to an embodiment of the disclosure.

Referring to FIG. 12, a partially completed shank portion 48*d* is depicted according to an embodiment of the disclosure. The partially completed shank portion 48*d* includes many of the same attributes as shank portions 48*a*, 48*b*, and 48*c*, some of which are indicated with same-labeled reference characters. A distinction of the partially completed shank portion 48*d* is that the bore 38 does not extend through the proximal face 134. That is, the partially completed shank portion 48*d* includes only a partial chamber 47'.

Functionally, the partially completed shank portion 48*d* may be utilized to circumvent concerns related to short barreled rifles (SBRs) prior to assembly of an integrated removable barrel. Shank portions 48*b* and 48*c* are technically capable of assembling to the receiver 32 and holding the cartridge 52. As such, a concern is that the shank portions 48*b* and 48*c* in combination with the receiver 32 may be considered a SBR that is subject to state or federal restrictions. More generally, a concern is the shank portions 48*b* and 48*c* could be considered a component for an SBR.

The partially completed shank portion 48*d* is configured to alleviate this concern. The partial chamber 47' is incapable of facilitating an SBR. Accordingly, the partially completed shank portion 48*d* can be shipped as a component to manufacturing facilities without concern, where the partial chamber 47' can be machined to a completed chamber 47 during fabrication and assembly of the removable barrel 34*c*, 34*d*.

Figure 13:
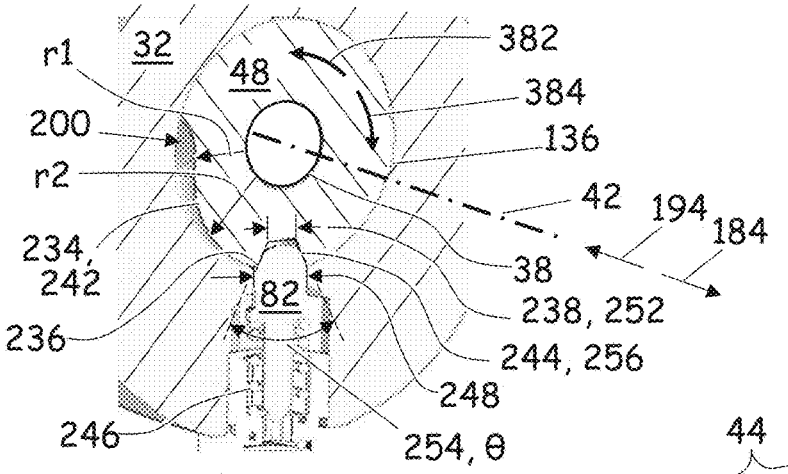
FIG. 13 is a partial sectional view at plane XIII of FIG. 1 depicting a plunger detent engaged with a notch detent according to an embodiment of the disclosure.

Referring to FIG. 13, the receiver 32 and removable barrel 34 are depicted in the fully interlocked configuration 88 at plane XIII of FIG. 1 according to an embodiment of the disclosure. In some embodiments, a line of actuation radii 234 relative to the barrel axis 42 is defined along the plunger track 200, the line of actuation radii 234 increasing in value as the plunger track 200 approaches a rotational extremity 236. Example actuation radii r1 and r2 from the line of actuation radii 234 are depicted. Actuation radius r2, being tangentially closer to the rotational extremity 236, is greater than actuation radius r1. In some embodiments, the plunger track 200 is defined by a plunger channel 238 radially recessed from the outer surface 136 of the shank diameter 138, in which case the line of actuation radii 234 defines a line of minimum radii 242 of the plunger channel 238.

In some embodiments, the shank portion 48 defines a detent notch 244 at the rotational extremity 236 of the plunger track 200. The detent plunger 82 may be biased radially inward with a biasing element 246 to seat the detent plunger 82 with the detent notch 244 to maintain the removable barrel 34 and the receiver 32 in a fixed rotational relationship. The biasing element 246 may be a coil spring (depicted). The detent notch 244 defines a first dimension 248 at the outer surface 136 of the shank portion 48 and a second dimension 252 that is radially inset from the outer surface 136 of the shank portion 48. The second dimension 252 may be less than the first dimension 248 to define a taper 254, wherein the taper 254 includes tangentially opposed surfaces 256 that define a taper angle θ therebetween. In some embodiments, the taper angle θ is in a range from 40 to 90 degrees inclusive; in some embodiments, in a range from 40 to 70 degrees inclusive; in some embodiments, in a range from 45 to 55 degrees inclusive.

Figure 14:
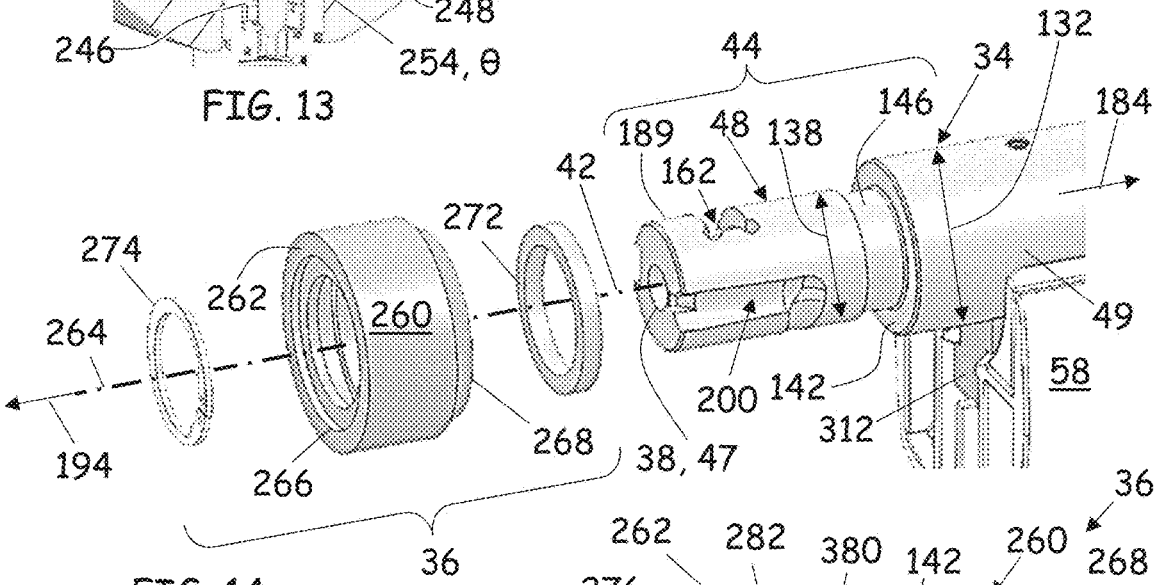
FIG. 14 is an exploded view of a tensioner assembly at the proximal end portion of the removable barrel of FIG. 6 according to an embodiment of the disclosure.
Figure 15:
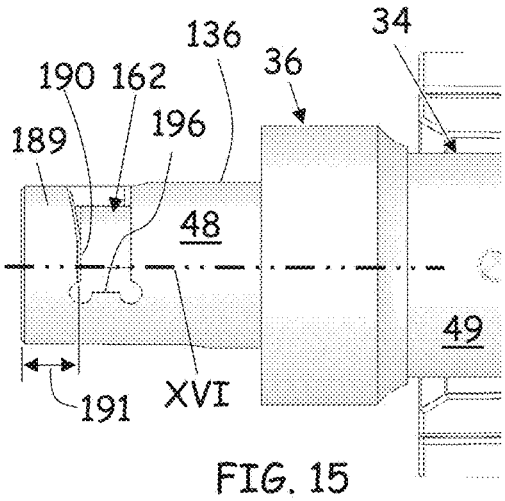
FIG. 15 is a plan view of the tensioner assembly and proximal end portion of the removable barrel of FIG. 14 in an assembled configuration according to an embodiment of the disclosure.
Figure 16:
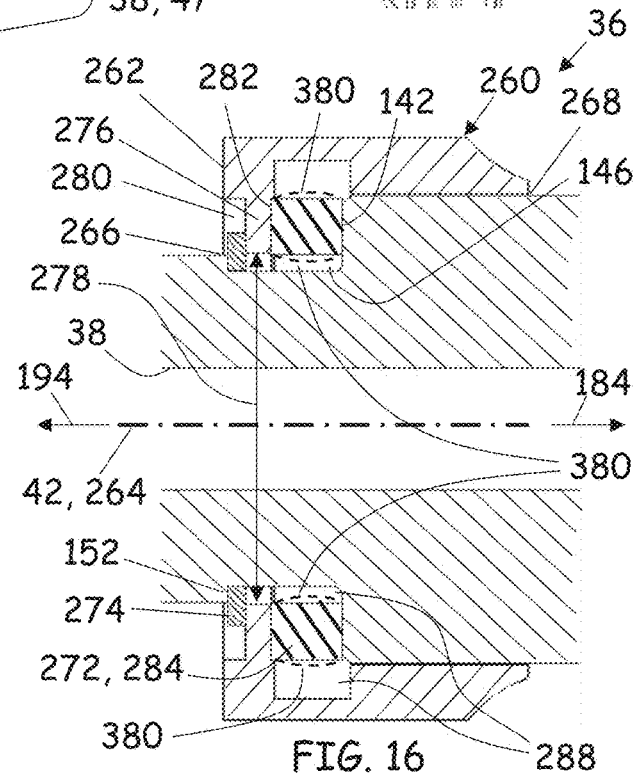
FIG. 16 is an enlarged sectional view of the tensioner assembly and removable barrel at plane XVI of FIG. 15 according to an embodiment of the disclosure.

Referring to FIGS. 14 through 16, the tensioner assembly 36 is depicted in greater detail according to an embodiment of the disclosure. The tensioner assembly 36 includes a collar 260 having a proximal face 262 and defines and is concentric about a tensioner axis 264, the collar 260 defining a proximal opening 266 and a distal opening 268 of the tensioner assembly 36. The proximal opening 266 may be greater than the shank diameter 138. The distal opening 268 may be configured to receive the outer dimension 132 of the proximal end portion 44. In some embodiments, a biasing element 272 is disposed between the collar 260 and the shoulder 142 of the barrel body 49. In some embodiments, the tensioner assembly 36 includes a retaining ring 274 that axially captures the collar 260 about the neck 146 of the shank portion 48. Here, to "axially capture" the collar 260 is to limit axial translation of the collar 260 between the retaining ring 274 and the shoulder 142 of the barrel body 49 while permitting translation therebetween.

The collar 260 may include an inner flange 276 disposed between the proximal opening 266 and the distal opening 268. The inner flange 276 defines an inner diameter 278 that is less than the proximal opening 266 and the distal opening 268, such that the biasing element 272 is axially captured between the inner flange 276 and the shoulder 142 of the barrel body 49. In some embodiments, the inner flange 276 of the collar 260 is inset from the proximal opening 266 to define a counterbore 280 that faces in the proximal direction 194. The axial depth of the counterbore 280 relative to the proximal face 262 may be greater than the thickness of the retaining ring 274. In some embodiments, the inner flange 276 defines a spot faced recess 282 that faces in the distal direction 184 for centering the biasing element 272 about the tensioner axis 264.

In assembly, the biasing element 272 is registered against the shoulder 142 of the barrel body 49. The collar 260 is slid over the shank portion 48 so that the biasing element 272 is interstitially disposed between the inner flange 276 of the collar 260 and the shoulder 142 of the barrel body 49. For collars 260 that include the spot faced recess 282, the biasing element 272 may be centered or otherwise seated within the spot faced recess 282. In some embodiments, the biasing element 272 is compressed between the collar 260 and the shoulder 142 of the barrel body 49 to enable installation of the retaining ring 274 distal to the shank shoulder 152. The counterbore 280 may enable the retaining ring 274 to be flush or distal to the proximal face 262 of the collar 260 so that the collar 260 surrounds and may conceal or partially conceal the retaining ring 274 after installation.

The biasing element 272 may be configured to provide an axial spring constant that is within a predetermined range. In some embodiments, the biasing element 272 includes an clastic body having a modulus of elasticity that is within a range of 10 to 20 megapascals (MPa) inclusive. For example, the biasing element 272 may be an o-ring 284. The o-ring 284 may define a square or rectangular cross-section 286 normal to the tangential direction (depicted). In some embodiments, the collar 260 and neck 146 provide diametral clearances 288 about the o-ring 284.

Figure 17:
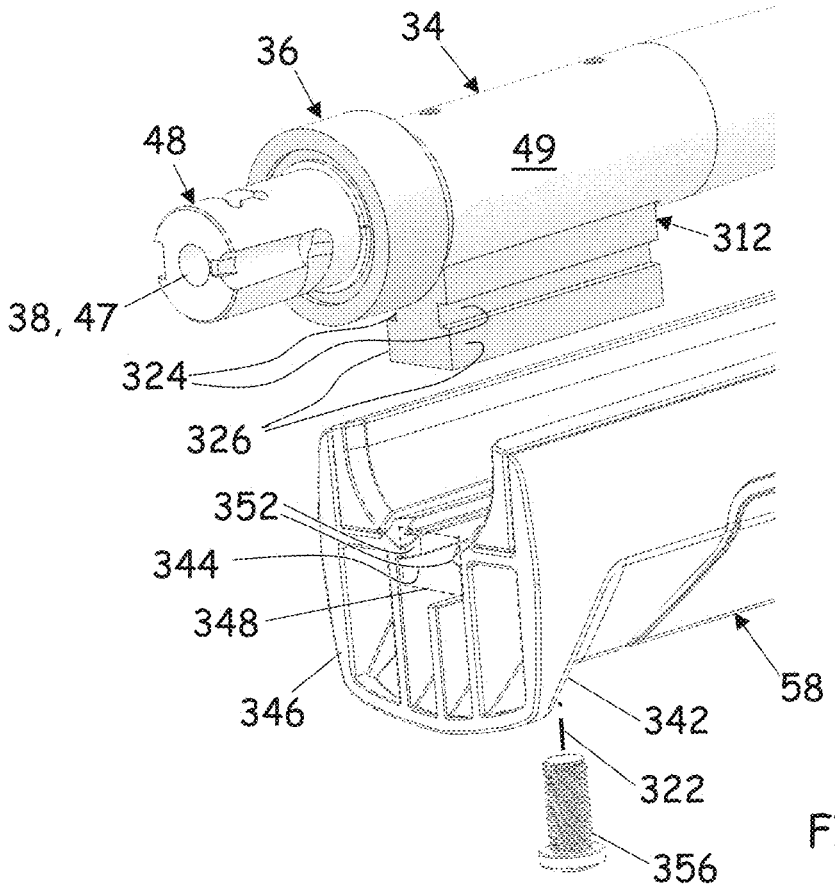
FIG. 17 is an exploded view of the removable barrel and fore end of FIG. 1 according to an embodiment of the disclosure.
Figure 18:
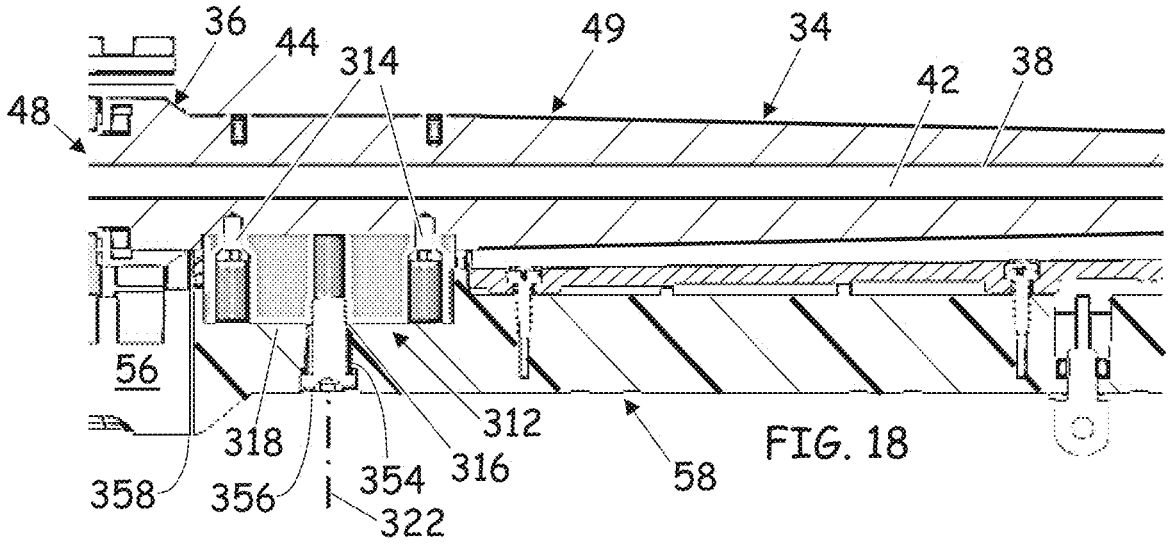
FIG. 18 is a partial sectional view of the removable barrel and fore end at a mid-plane of FIG. 1 according to an embodiment of the disclosure.

Referring to FIGS. 17 and 18, assembly of the fore end 58 to the removable barrel 34 is depicted according to an embodiment of the disclosure. In the depicted embodiment, a barrel attachment 312 is secured to the removable barrel 34 for attachment of the fore end 58. The barrel attachment 312 may be secured to the removable barrel 34, for example, with screws 314. In some embodiments, the barrel attachment 312 defines a tapped mounting hole 316 that is accessible from a bottom face 318 of the barrel attachment 312, the tapped mounting hole 316 defining and extending along a mounting axis 322. In some embodiments, the barrel attachment 312 defines one or more axially extending undercuts 324. The undercut(s) 324 may be disposed on opposed lateral faces 326 of the barrel attachment 312 and may define, for example, a square (depicted) or a dovetail profile.

The fore end 58 includes a proximal end 342 portion that defines a pocket 344 into which the barrel attachment 312 is inserted. In some embodiments, the pocket 344 extends through a proximal face 346 of the fore end 58 to define a pocket access 348 through which the barrel attachment 312 is inserted into the pocket 344. The fore end 58 may define one or more rails 352 that are configured to slide into the one or more undercuts 324 of the barrel attachment 312. In some embodiments, the fore end 58 defines a mounting through-hole 354 that aligns with the tapped mounting hole 316 of the barrel attachment 312 when the fore end 58 is in assembly position.

In assembly, the pocket access 348 of the fore end 58 is axially aligned with the barrel attachment 312 and the rail(s) 352 axially aligned with the undercut(s) 324. The fore end 58 is axially slid onto the barrel attachment 312. In some embodiments, the pocket 344 and rails 352 and/or barrel attachment 312 and undercuts 324 are configured to provide a close sliding or light interference fit as the fore end 58 is slid onto the barrel attachment 312.

The fore end 58 is slid over the barrel attachment 312 so that the mounting through-hole 354 of the fore end 58 lines up with the tapped mounting hole 316 of the barrel attachment 312 for insertion of a mounting fastener 356. In some embodiments, the fore end 58 is dimensioned and the mounting axis 322 located so that a gap 358 is defined between the fore end 58 and the stock 56.

Functionally, the gap 358 isolates the fore end 58 from the receiver 32 and stock 56 to mitigate unfavorable harmonic effects. Clamping the fore end 58 to the barrel attachment 312 with the mounting fastener 356 provides a rigid joint that limits play of the fore end 58 via pitch, roll, or yaw. The barrel attachment 312 and the associated close sliding or light interference fits may be at the proximal end portion 44 of the removable barrel 34 (i.e., just distal to the shank portion 48, where the user holds the fore end 58 for installation) so that a substantial portion of the removable barrel 34 is not in contact with the fore end 58. As such, the section of the removable barrel 34 that is forward of the barrel attachment 312 is effectively free floating, thereby avoiding unfavorable harmonics.

Figure 19:
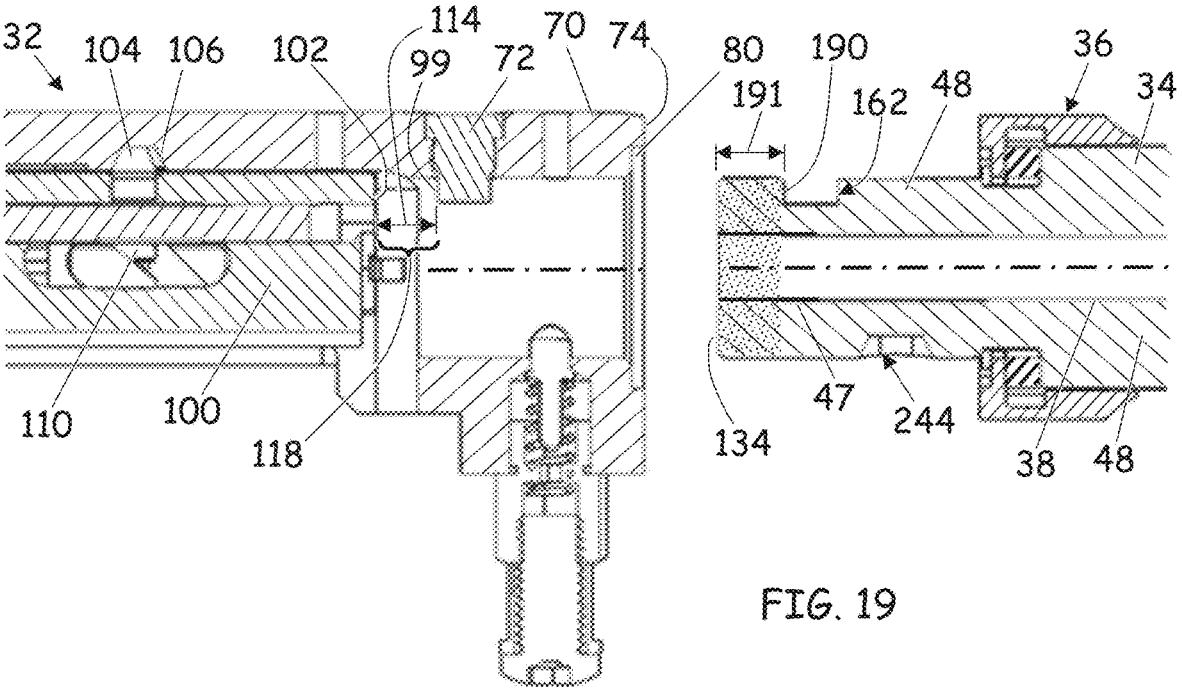
FIG. 19 is a partial sectional view at the mid-plane of the firearm of FIG. 1 with the removable barrel aligned for installation according to an embodiment of the disclosure.
Figure 20:
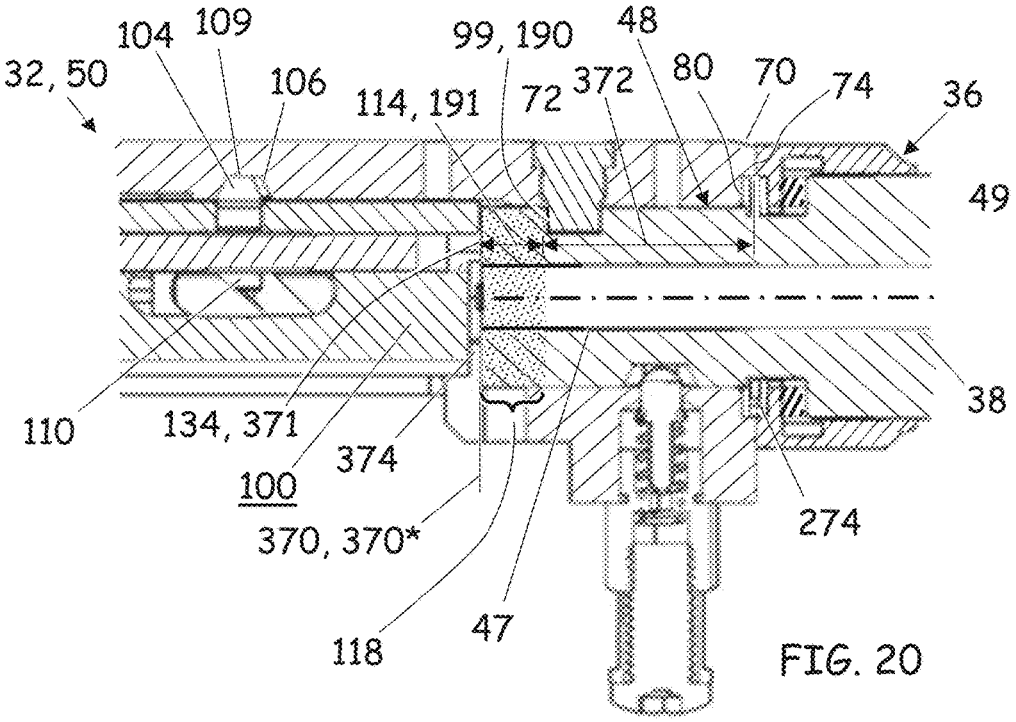
FIG. 20 is the partial sectional view of FIG. 19 in an interlocked configuration according to an embodiment of the disclosure.

Referring to FIGS. 19 and 20, the functionality of various components and dimensions of the receiver 32 and removable barrel 34 is described according to an embodiment of the disclosure. The locking stud 72 as press fit into the receiver 32 defines several functional dimensions. The fixed position and orientation of the locking interface 99 determines a position 370 of the proximal face 134 of the shank portion 48, which in turn defines a chamber face 371 of the rimfire takedown firearm 30 when in the fully interlocked configuration 88. The distance from the locking interface 99 of the locking stud 72 to the distal face 74 of the front receiver ring 70 defines a barrel tension distance 372.

The portrayal of the fully interlocked configuration 88 in FIG. 20 depicts an ideal position 370* of the proximal face 134 of the shank portion 48 (i.e., the chamber face 371) for an assembled rimfire takedown firearm 30. That is, the position 370 of the proximal face 134 of the shank portion 48 precisely corresponds to the contact location of the bolt face 102 when the bolt assembly 100 is in the battery configuration 50 (i.e., with the locking lug 104 set against the proximal extremity 108 of the locking pocket 106 and engaged with the upper surface 109 of the locking pocket 106). Of course, the various components (including, but not limited to, the locking stud 72, the interlocking segment 189, the bolt assembly 100, and the locking pocket 106) and their positions, as well as the repeatability of fully interlocked configuration 88, are subject to uncertainties associated, for example, with corresponding machining tolerances. Because of these uncertainties, the position 370 of the chamber face 371 may not always be ideal.

Figure 20A:
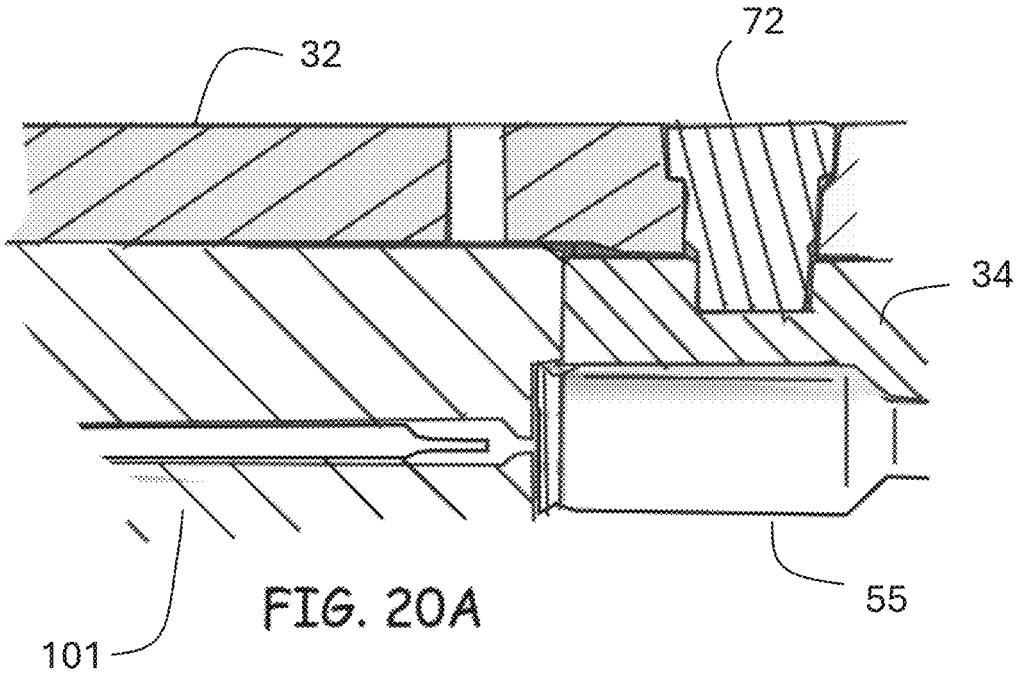
FIG. 20A is a partial sectional view similar to FIG. 20 but with the firearm configured for centerfire ammunition.

Referring to FIG. 20A, an embodiment is illustrated with a centerfire cartridge 55 and bolt assembly 101 adapted for the centerfire cartridge.

Figure 21:
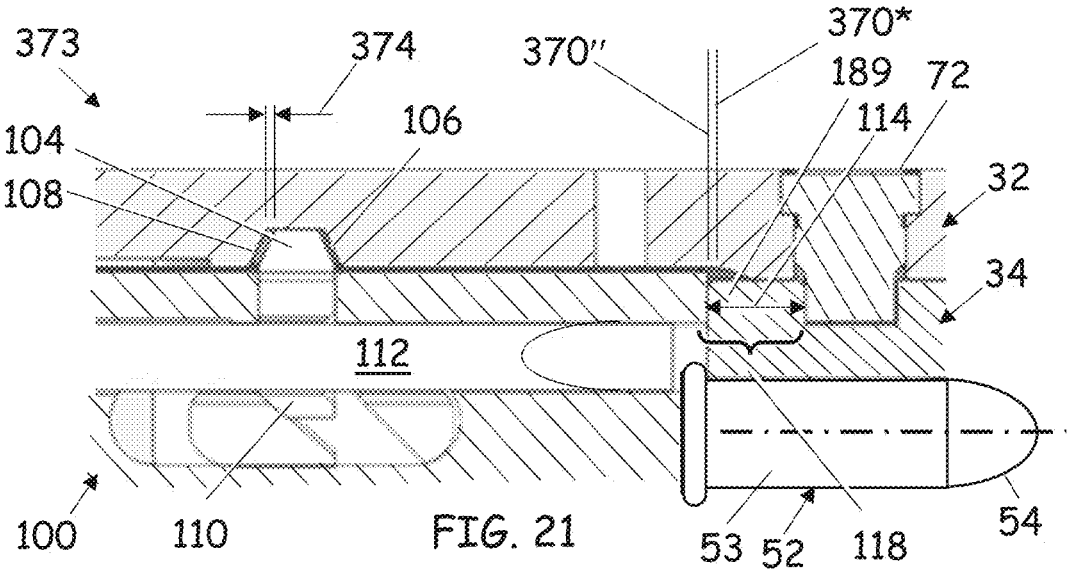
FIGS. 21 and 22 are enlarged partial sectional views of an "overspaced" chamber arrangement.
Figure 22:
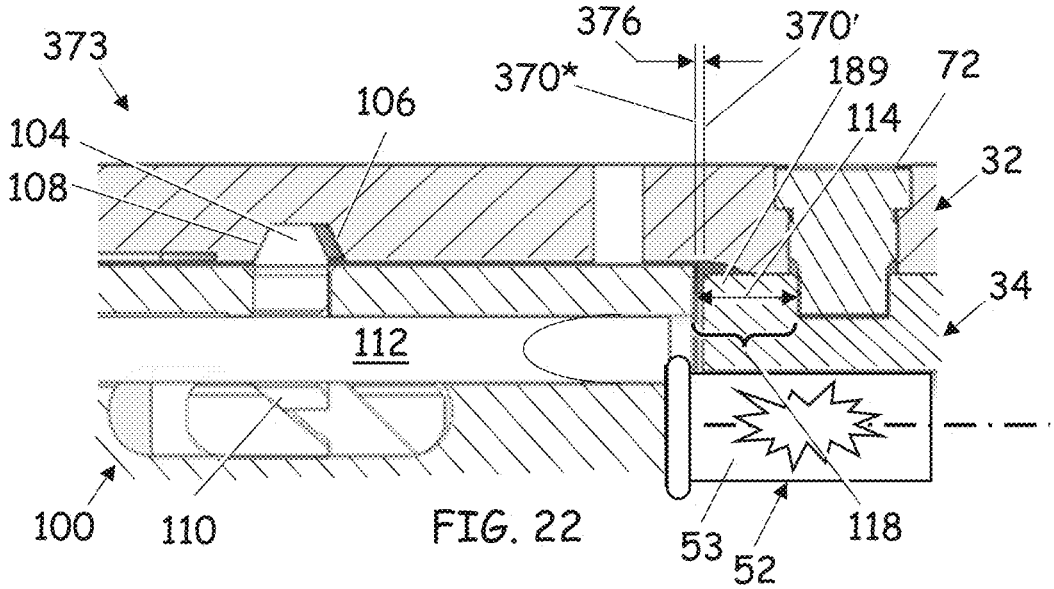
Figure 23:
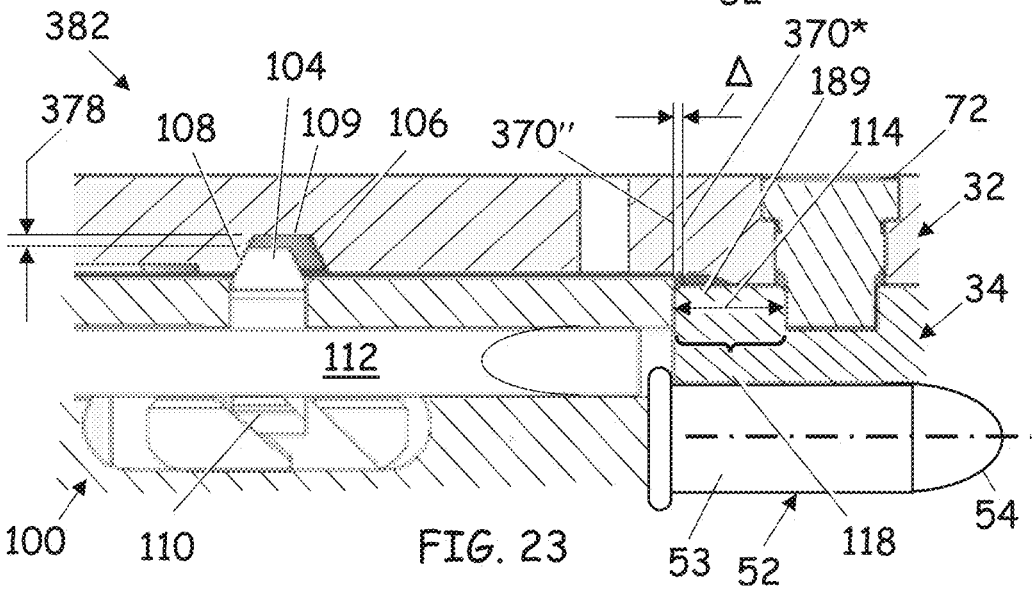
FIG. 23 is an enlarged partial sectional view of an "underspaced" chamber arrangement according to an embodiment of the disclosure.

Referring to FIGS. 21 through 23, the effects of non-ideal chamber positioning is illustrated. In one scenario, the interlocking segment 189 is undersized relative to the axial length of the interlocking zone 118 (FIGS. 21 and 22), thereby establishing a distally non-ideal position 370' of the chamber face 371. That is, the distally non-ideal position 370' of the chamber face is distal to the ideal position 370*. Because the interlocking segment is undersized, the corresponding interlocking zone 118 is effectively oversized. Hence, this scenario is referred to as an "overspaced" chamber arrangement 373.

In the "overspaced" chamber arrangement 373, the distally non-ideal position 370' causes the bolt face 102 to seat forward of the ideal position 370* when contacting the chamber face 371, causing the locking lug 104 to be loosely positioned within the locking pocket 106 (FIG. 21). The loose position of the locking lug 104 may be characterized by an axial gap 374 between the locking lug 104 and the proximal extremity 108 of the locking pocket 106 when the bolt face 102 is registered against the chamber face 371. Upon discharge of the rimfire takedown firearm 30, the bolt assembly 100, being effectively unlocked in the axial direction, is thrust proximally (rearward), so that a breech gap 376 develops between the bolt face 102 and the chamber face 371 (FIG. 22). The breech gap 376 causes the casing of the cartridge 52 to be unsupported, which can cause failure of the casing during the high pressures associated with discharge. Such failure poses a safety hazard.

In another scenario, herein referred to as an "underspaced" chamber arrangement 382, the interlocking segment 189 is oversized relative to the axial length of the interlocking zone 118 (FIG. 23), which establishes a proximally non-ideal position 370" of the chamber face 371. That is, the proximally non-ideal position 370" of the chamber face 371 is proximal to the ideal position 370*. The proximally non-ideal position 370' causes the bolt face 102 to seat rearward of the ideal position 370* when contacting the chamber face 371, which in turn causes the locking lug 104 to not extend fully upward within the locking pocket 106 when registered against the proximal extremity 108. That is, a vertical gap 378 develops between the upper face 109 of the locking pocket 106 and the locking lug 104, such that the locking lug 104 and stem 110 is positioned downward relative to the battery configuration 50.

If the stem 110 is sufficiently positioned downward, the firing pin 112 is blocked and the rimfire takedown firearm 30 is inoperable. However, there is a finite downward distance that the stem 110 must travel before the firing pin 112 is effectively blocked. As such, delayed blowback bolt systems can safely operate for embodiments where interlocking segment 189 is oversized relative to the axial length of the interlocking zone 118 to within an acceptable tolerance. Stated another way, the interlocking zone 118 is underspaced. This arrangement is herein referred to as an "underspaced" chamber arrangement 382.

In some embodiments, this acceptable tolerance corresponds to a difference A between the ideal position 370* and the proximally non-ideal position 370" that is in a range of 0 to 12 mils inclusive (one mil equaling 0.001 inch), even though the breech of the action is technically out-of-battery. Accordingly, the removable barrel 34 can be up to 12 mils rearward from the ideal battery location without concern. That is, the interlocking segment 189 of the shank portion 48 (i.e., the locking seat offset 191) can be equal to or as much as 12 mils greater than the interlocking zone 118 and still operate safely. The ability to oversize the interlocking segment 189 and thereby "underspace" the interlocking zone 118 enables the removable barrel 34 to be manufactured to within larger tolerances.

In addition, the ability to remove the removable barrel 34 enables selectively fitting the takedown firearm 30 with any one of different caliber barrels and still operate safely as long as the specified "underspace" tolerance is met. The use of different calibers on the same takedown firearm 30 is a function of the locking system. Furthermore, the receiver 32 can accommodate removable barrels 34 of different interlocking angles. That is, the receiver 32 may accommodate removable barrels 34 that have different rotation angles to achieve the fully interlocked configuration 88. In some embodiments, the rotation angle of the removable barrels 34 may vary from 15 degrees to 90 degrees inclusive.

In some embodiments, whether is chambering "overspaced" or "underspaced" is of no concern. For example, straight blowback configurations, for which there is no locking lug interaction, may implement the removable barrel 34 and the front receiver ring 70 as disclosed herein. Such straight blowback embodiments do not require the same considerations with regard to chambering as delayed blowback embodiments depicted herein.

Regarding the function of the tensioner assembly 36, various components and attributes of the receiver 32, removable barrel 34, and tensioner assembly 36 generate a force between the shank portion 48 and the front receiver ring 70 for locking the removable barrel 34 to the receiver 32 during assembly. When the removable barrel 34 is mounted to the receiver 32, the distal face 74 of the receiver 32 contacts the proximal face 262 of the collar 260 and an axial force is exerted so that the collar 260 is displaced in the distal direction 184 along the removable barrel 34. The distal displacement causes compression of the of the biasing element 272 (e.g., compression of the o-ring 284 between the shoulder 142 of the barrel body 49 and the inner flange 276 of the collar 260). As the collar 260 is displaced in the distal direction 184, the retaining ring 274 may remain at or close to the shank shoulder 152 due to friction between the retaining ring 274 and the neck 146. As the removable barrel 34 is pushed into the receiver 32, the counterbore 80 can receive the retaining ring 274 without contacting the receiver 32 (FIG. 20), thus preventing the retaining ring 274 from canting and binding on the neck 146, which could generate excessive resistance to the insertion of the removable barrel 34 into the receiver 32.

For embodiments where the o-ring 284 is used as a compressive member, the square or rectangular profile 286 provides greater stiffness than a round cross section for generating enhanced tension as the tensioner assembly 36 is rotated against the front receiver ring 70 and into the fully interlocked configuration 88. The diametral clearances 288 enable the biasing element 272, such as the o-ring 284, expand radially inward and radially outward when compressed (depicted with phantom lines 380 in FIG. 15), thereby avoiding interference between the biasing element 272 and the collar 260 and shank portion 48. This prevents the tensioner assembly 36 from acting like a compression fitting when in the fully interlocked configuration 88, which could significantly and adversely increase torsional requirements for assembly and take down.

Resistance to the rotation of the removable barrel 34 in a disassembly rotation direction 382 rotationally secures the removable barrel 34 and receiver 32 in the fully interlocked configuration 88. Contributions to the rotational resistance include: the degree of the taper angle θ of the tangentially opposed surfaces 256 of the detent notch 244 that the detent plunger 82 overcomes to disengage from the detent notch 244; the friction between the locking stud 72 and the locking seat 190 on the removable barrel 34; and the friction between the tensioner assembly 36 and an outer surface of the removable barrel 34. The combination of frictional interfaces (plunger/detent notch, locking stud/locking face, shank/receiver, tensioner/receiver) provide rotational retention between the receiver 32 and the removable barrel 34, enabling sufficient barrel tension that can be readily deactivated to quickly remove the removable barrel 34. It is also noted that a right-handed shooter will position his off (left) hand on the left side of the fore end 58. This small force acts favorably in an assembly rotation direction 384. By preventing rotation of the removable barrel 34 relative to the receiver 32, the axial compression of the biasing element 272 within the tensioner assembly 36 is maintained as well as the biasing force of the locking seat 190 against the locking interface.

In this way, a sufficient but not excessive rotational resistance can be tailored to keep the removable barrel 34 in position. In designing the rimfire takedown firearm 30, parametric considerations that affect the rotational resistance include: the barrel tension distance 372; the taper angle θ and depth of the detent notch 244; the surface finish between sliding components, such as between the locking seat 190 and locking interface 99 and between the collar 260 and the receiver 32. Other parameters can be tweaked post-fabrication to increase or decrease the rotational resistance, including: the effective axial spring constant of the biasing element 272 (for example, where the biasing element 272 is the o-ring 284, by material selection that changes the modulus of elasticity of); the thickness and shape of the biasing element 272 (e.g., a square versus a circular cross-section 286 of the o-ring 284 and the cross-sectional dimensions); the frictional characteristics at the interface of the biasing element 272 and the collar 260; the spring constant of the biasing element 246 of the plunger 82; lubrication between sliding surfaces. In some embodiments, the rotational resistance is tailored to be within a range of 20 to 35 inch-pounds force (in-lbf) of torsion.

The rotation stop 196 prevents over-rotation in the assembly rotation direction 384. The rotation stop 196 engages the locking stud 72 if the removable barrel 34 is rotated past center in the assembly rotation direction 384, for example nominally 2.5 degrees past center. This enables consistent center alignment while preventing the removable barrel 34 from being rotated so as to exert a shear load on the extractor 232 (FIG. 5). As such, shear loading of the extractor 232 is only possible in the disassembly rotation direction 382, which is tailored to require a substantial (and therefore typically deliberate) rotational force to dislodge, as discussed above. In some embodiments, the detent plunger 82 is unseated from the detent notch 244 by application of a rotational force (torsion) between the receiver 32 and the removable barrel 34. In some embodiments, the biasing element 246 exerts a force on the detent plunger 82 that is in a range of 5 to 10 lbf inclusive when the detent plunger 82 is seated in the detent notch 244.

The increase of the radii of the line of actuation radii 234 effectively provides a ramp that extends radially outward as the detent plunger 82 approaches the detent notch 244 during interlocking, so that the detent plunger 82 "climbs over" edge of the detent notch 244. In this way, the plunger track 200 preserves the depth of the detent notch 244 and guides the detent plunger 82 into the detent notch 244 in the fully interlocked configuration 88. For embodiments where the plunger track 200 includes the corresponding axial run 206, the actuation radii may also increase along the axial run 206 in the distal direction 184.

Figure 24:
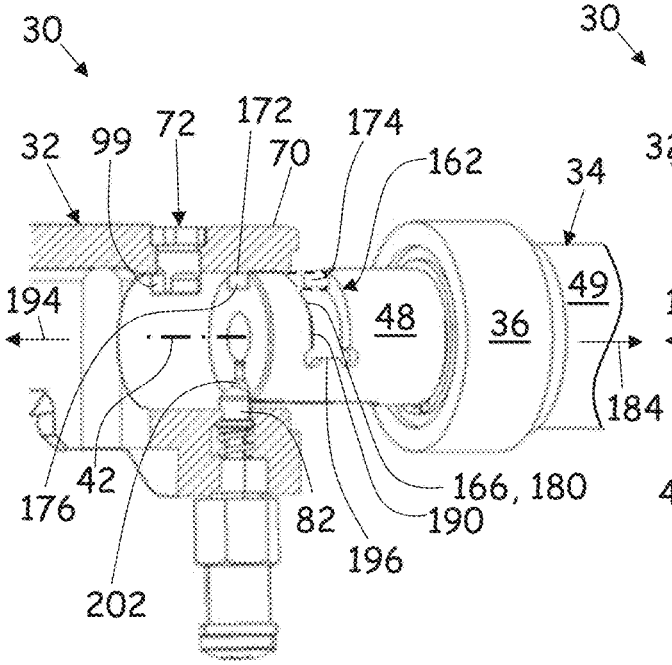
FIGS. 24 through 27 are rear perspective views of the firearm of FIG. 1 during assembly according to an embodiment of the disclosure.
Figure 25:
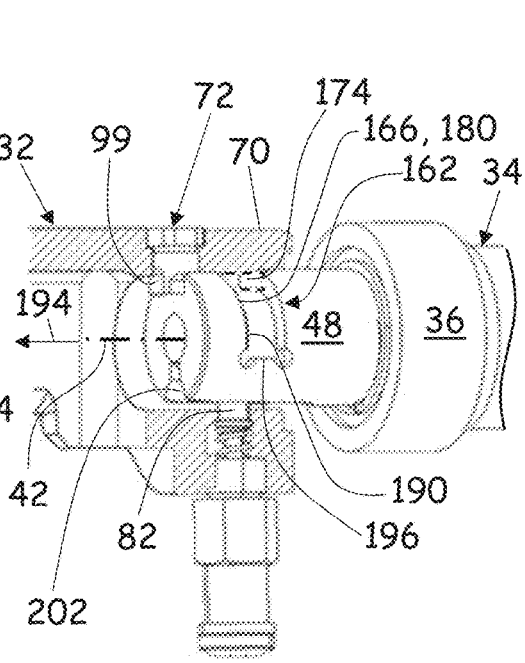
Figure 26:
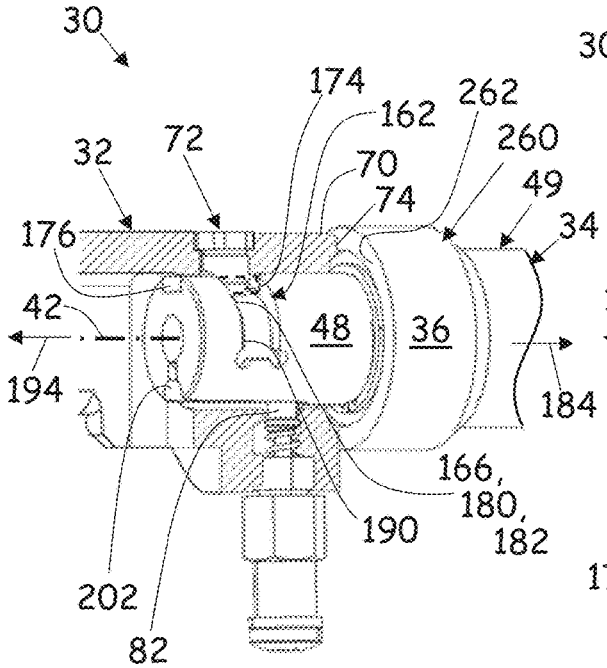
Figure 27:
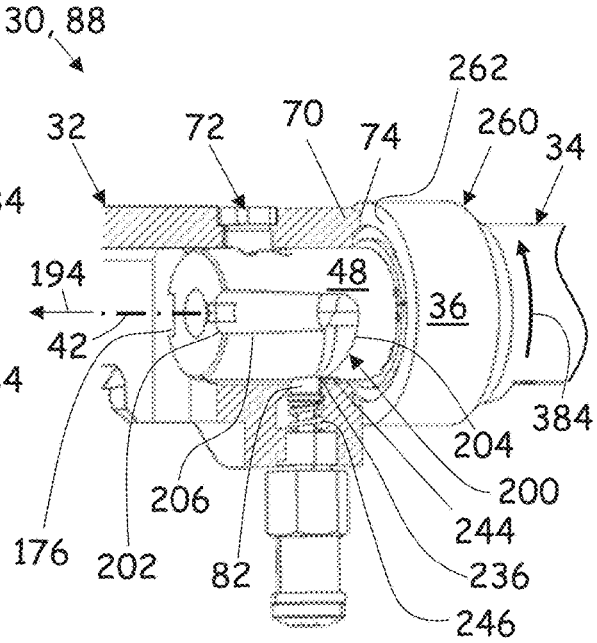

Referring to FIGS. 24 through 27, operation of the rimfire takedown firearm 30 is depicted according to embodiments of the disclosure. The shank portion 48 is inserted into the front receiver ring 70 so that the locking stud 72 is aligned at the access 176 to the locking stud track 162 (FIG. 24). For embodiments that include the detent plunger 82, the shank portion 48 is also aligned at the access to the plunger track 200 (FIG. 25). For embodiments where the locking stud track 162 includes the straight axial run 172, the shank portion 48 is translated axially into the front receiver ring 70 so that the locking stud 72 is tangentially aligned with the inlet 174 to the cylindrical cam 166 (FIG. 26). The removable barrel 34 is rotated in the assembly rotation direction 384, causing the locking stud 72 to follow the cam surface 180 of the cylindrical cam 166 to the locking seat 190 of the locking stud track 162 (FIG. 27). Accordingly, the locking stud track 162 cooperates with the locking stud 72 to guide the removable barrel 34 into the fully interlocked configuration 88 with the receiver 32. Herein, the assembly rotation direction 384 is depicted as clockwise about the barrel axis 42 when viewed in the proximal direction 194; the disassembly rotation direction 382 is depicted as counterclockwise about the barrel axis 42 when viewed in the proximal direction 194. Such rotation directions for assembly and disassembly are not limiting.

As the removable barrel 34 is rotated into the fully interlocked configuration 88 with the receiver 32, the axial incline or convexity 182 of the cam surface 180 acts against the locking stud 72 in the distal direction 184 and causes the removable barrel 34 to translate proximally, so that the shank portion 48 is translated further into the front receiver ring 70. This action causes a compressive force at the interface of the distal face 74 of the front receiver ring 70 and the proximal face 262 of the collar 260 of the tensioner assembly. The compressive force increases the compression of the biasing element (o-ring 284), so that the tensioner assembly 36 effectively exerts reactive force against the receiver 32, thereby biasing the detachable barrel 34 in the distal direction 184. Such biasing of the detachable barrel in the distal direction 184 results in a retention force that secures the locking seat 190 of the locking stud track 162 against the locking interface 99 of the locking stud 72 when the shank portion 48 and front receiver ring 70 are interlocked. In some embodiments, when the removable barrel 34 is rotated in the assembly rotation direction 384, the tensioner assembly 36 first rotates with the removable barrel 34. As the tensioner assembly 36 engages the receiver 32 and compresses the o-ring 284, the friction between the tensioner assembly 36 and the receiver 32 may be such that the tensioner assembly 36 stops rotating.

The detent plunger 82, when utilized, slides along the corresponding axial run 206 of the plunger track 200 (FIG. 25) for tangential alignment with the tangential run 204 of the plunger track 200, and follows the tangential run 204 of the plunger track 200 into the detent notch 244 as the removable barrel 34 is rotated into the fully interlocked configuration 88 (FIG. 26). As the detent plunger 82 traverses the tangential run 204 during interlocking of the removable barrel 34 and the receiver 32, the detent plunger 82 follows the line of actuation radii 234 radially outward, thereby causing the detent plunger 82 to actuate radially outward as it approaches the detent notch 244. As the locking stud 72 engages the locking seat 190, the detent plunger 82 enters and is actuated radially inward into the detent notch 244, for example by the plunger biasing element 246.

In the fully interlocked configuration 88, the detent plunger 82 is registered within the detent notch 244 and the distal face 74 of the front receiver ring 70 registers against the proximal face 262 of the collar 260 to compress the biasing element 272. When in the fully interlocked configuration 88, the locking stud 72 registers against the locking seat 190 of the locking stud track 162 to establish the locking stud offset 114 from the locking interface 99 the locking stud 72 to the proximal face 134 of the shank portion 48.

A cylindrical coordinate system r-θ-z is presented at FIG. 6. The cylindrical coordinate system r-θ-z is of arbitrary origin along the barrel axis 42, with the z-coordinate aligned with the barrel axis 42 in the distal direction 184. Herein, "radial" refers to a direction along or parallel to the r-coordinate, "tangential" refers to a direction along or congruent with the θ-coordinate, and "axial" refers to a direction parallel to the z-coordinate. References to "front", "bottom", and "rear" assume the takedown firearm 30 is oriented with the barrel axis 42 substantially horizontal and being held by a user normally would for firing.

Each of the additional figures and methods disclosed herein can be used separately, or in conjunction with other features and methods, to provide improved devices and methods for making and using the same. Therefore, combinations of features and methods disclosed herein may not be necessary to practice the disclosure in its broadest sense and are instead disclosed merely to particularly describe representative and preferred embodiments.

Various modifications to the embodiments may be apparent to one of skill in the art upon reading this disclosure. For example, persons of ordinary skill in the relevant arts will recognize that the various features described for the different embodiments can be suitably combined, un-combined, and re-combined with other features, alone, or in different combinations. Likewise, the various features described above should all be regarded as example embodiments, rather than limitations to the scope or spirit of the disclosure.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

The following patents and patent application publications, which are owned by the applicant of the present application, are hereby incorporated by reference herein in their entirety: U.S. Pat. Nos. 9,599,417, 9,810,496, 9,513,076, and 10,788,277; U.S. Patent Application Publication No. 2021/0148662. Any incorporation by reference in this application is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

Unless indicated otherwise, references to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A takedown firearm, comprising:

a receiver, including:

a front receiver ring that includes a distal face and defines an inside diameter;

a locking stud that extends radially inward relative to said inside diameter; and a detent plunger that extends radially inward relative to said inside diameter, said detent plunger and said locking stud being centered about a common plane, a removable barrel defining a barrel axis and defining an outer dimension at a proximal end portion, said proximal end portion including a shank portion, wherein said shank portion:

includes a proximal face and an outer surface that defines a shank diameter dimensioned for a close sliding fit with said inside diameter of said front receiver ring, said shank diameter being less than said outer dimension of said proximal end portion of said removable barrel to define a shoulder at a junction of said outer dimension and said shank portion;

includes a locking stud track configured to guide said locking stud axially and rotationally during assembly;

includes a plunger track configured to guide said detent plunger axially and rotationally during assembly; and defines a detent notch at a rotational extremity of said plunger track, and a tensioner assembly including a biasing element and a collar, said collar having a proximal face that defines and is concentric about a tensioner axis, said tensioner assembly defining a proximal opening and a distal opening, said proximal opening being greater than said shank diameter, said distal opening being configured to receive said outer dimension of said proximal end portion, said biasing element being disposed between said collar and said shoulder, wherein said shank portion is insertable into said front receiver ring so that said locking stud track guides said locking stud and said plunger track guides said detent plunger to an interlocked configuration, and wherein, in said interlocked configuration, said detent plunger is registered within said detent notch and said distal face of said front receiver ring registers against said proximal face of said collar to compress said biasing element.

2. The takedown firearm of claim 1, wherein, when in said interlocked configuration, said locking stud registers against a locking face of said track to establish a locking stud offset from said locking stud to said proximal face of said shank portion.

3. The takedown firearm of claim 1, wherein said locking stud track defines a cylindrical cam for guiding said locking stud in a tangential direction during assembly.

4. The takedown firearm of claim 3, wherein said cylindrical cam defines a slope relative to a radial-tangential plane of said shank, said slope being in a range of 5 degrees to 20 degrees inclusive.

5. The takedown firearm of claim 4, wherein said slope varies along a tangential length of said cylindrical cam within said range of 5 degrees to 20 degrees inclusive.

6. A takedown firearm, comprising:

a receiver ring that defines an inside diameter;

a locking stud that extends radially inward from said inside diameter of said receiver ring;

a removable barrel including a shank portion and a barrel body portion, said shank portion being insertable into said receiver ring and including a locking stud track configured to guide said removable barrel axially and rotationally over said locking stud during assembly; and a tensioner assembly disposed between said barrel body portion and said receiver ring, said tensioner assembly including a biasing element, wherein said shank portion is insertable into said receiver ring so that said locking stud track guides said locking stud to an interlocked configuration with said removable barrel, and wherein, in said interlocked configuration, said tensioner assembly is disposed between said receiver ring and said barrel body portion to bias said removable barrel in a distal direction relative to said receiver ring.

7. The takedown firearm of claim 6, comprising a detent plunger that extends radially inward from said inside diameter of said receiver ring, said shank portion including a plunger track configured to guide said detent plunger axially and rotationally during assembly.

8. The takedown firearm of claim 7, wherein said shank portion defines a detent notch at a rotational extremity of said plunger track, wherein, in said interlocked configuration, said detent plunger is registered within said detent notch.

9. The takedown firearm of claim 7, wherein said detent plunger and said locking stud are centered about a common plane.

10. The takedown firearm of claim 9, wherein a barrel axis of said removable barrel is coplanar with said common plane.

11. The takedown firearm of claim 6, wherein:

said barrel body portion defines an outer dimension of said removable barrel;

said shank portion including a proximal face and an outer surface that defines a shank diameter dimensioned for a close sliding fit with said inside diameter of said receiver ring, said shank diameter being less than an outer dimension of said barrel body portion to define a shoulder at a junction of said outer dimension and said shank portion; and said tensioner assembly is registered between and against said receiver ring and said barrel body portion to compress said biasing element for the biasing of said removable barrel in said distal direction.

12. The takedown firearm of claim 11, wherein said tensioner assembly includes a collar having a proximal face that defines and is concentric about a tensioner axis, said tensioner assembly defining a proximal opening and a distal opening, said proximal opening being greater than said shank diameter, said distal opening being configured to receive said outer dimension of said barrel body portion at said junction, said biasing element being disposed between said collar and said shoulder of said removable barrel.

* * * * *